US010650737B2

(12) United States Patent
Vahid Far et al.

(10) Patent No.: US 10,650,737 B2
(45) Date of Patent: May 12, 2020

(54) HYBRID MICRO-DRIVER ARCHITECTURES HAVING TIME MULTIPLEXING FOR DRIVING DISPLAYS

(71) Applicant: Apple Inc., Cupertino, CA (US)

(72) Inventors: Mohammad B. Vahid Far, San Jose, CA (US); Yafei Bi, Palo Alto, CA (US); Kapil V. Sakariya, Los Altos, CA (US); Hopil Bae, Sunnyvale, CA (US); Shinya Ono, Cupertino, CA (US); Thomas Charisoulis, Mountain View, CA (US); Chin-Wei Lin, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/754,107

(22) PCT Filed: Sep. 21, 2016

(86) PCT No.: PCT/US2016/052954
§ 371 (c)(1),
(2) Date: Feb. 21, 2018

(87) PCT Pub. No.: WO2017/053477
PCT Pub. Date: Mar. 30, 2017

(65) Prior Publication Data

US 2018/0247586 A1 Aug. 30, 2018

Related U.S. Application Data

(60) Provisional application No. 62/233,247, filed on Sep. 25, 2015.

(51) Int. Cl.
*G09G 3/3216* (2016.01)

(52) U.S. Cl.
CPC ... *G09G 3/3216* (2013.01); *G09G 2310/0272* (2013.01); *G09G 2310/0297* (2013.01); *G09G 2310/066* (2013.01); *G09G 2320/064* (2013.01)

(58) Field of Classification Search
CPC .. G09G 3/3216; G09G 3/2003; G09G 3/2014; G09G 2320/064; G09G 2310/066;
(Continued)

(56) References Cited

U.S. PATENT DOCUMENTS 6,993,572 B2 1/2006 Ross, Jr. et al.
7,818,399 B1 10/2010 Ross, Jr. et al.
(Continued)

OTHER PUBLICATIONS

PCT International Search Report and Written Opinion for International Application No. PCT/US2016/052954, dated Dec. 20, 2016, 12 pages.

*Primary Examiner* — Andrew Sasinowski
(74) *Attorney, Agent, or Firm* — Jaffery Watson Mendonsa & Hamilton LLP

(57) ABSTRACT

Systems and apparatuses for hybrid micro-driver architectures having time multiplexing for driving displays are described. In one embodiment, a display (e.g., hybrid display architecture) includes a backplane and a micro-driver circuitry that is coupled to the backplane. The backplane includes circuitry (e.g., sample and hold circuitry) for sampling and holding analog data and for time multiplexing analog data. The micro-driver circuitry includes at least a capacitor of a ramp generator for generating a ramp voltage based on the analog data of the backplane and drive circuitry to cause at least one emission pulse for emitting a display element.

25 Claims, 22 Drawing Sheets

(58) Field of Classification Search
CPC ... G09G 2310/0297; G09G 2310/0294; G09G 2310/0235; G09G 2300/06; G09G 2310/0272
See application file for complete search history.

(56) References Cited

U.S. PATENT DOCUMENTS

| | | | | |
|---|---|---|---|---|
| 8,264,482 | B2 | 9/2012 | Miller et al. | |
| 8,791,474 | B1 | 7/2014 | Bibl et al. | |
| 10,395,589 | B1 | 8/2019 | Vahid Far et al. | |
| 10,395,590 | B1 | 8/2019 | Lin et al. | |
| 10,395,594 | B1 | 8/2019 | Charisoulis et al. | |
| 2002/0063672 | A1* | 5/2002 | Stevens | G09G 3/20 345/89 |
| 2002/0063728 | A1 | 5/2002 | Stevens | |
| 2005/0264472 | A1* | 12/2005 | Rast | G09G 3/14 345/30 |
| 2006/0132053 | A1 | 6/2006 | Cho et al. | |
| 2007/0057883 | A1* | 3/2007 | Cho | G09G 3/3648 345/88 |
| 2008/0225061 | A1* | 9/2008 | Kimura | G09G 3/3233 345/690 |
| 2012/0327063 | A1 | 12/2012 | Izawa et al. | |
| 2013/0100173 | A1 | 4/2013 | Chaji et al. | |
| 2014/0055115 | A1* | 2/2014 | Raval | H02M 3/156 323/288 |
| 2014/0168037 | A1 | 6/2014 | Sakariya et al. | |
| 2014/0285405 | A1* | 9/2014 | Nomura | G09G 3/3233 345/55 |
| 2014/0333676 | A1* | 11/2014 | Fujii | G09G 3/2003 345/690 |
| 2015/0339998 | A1 | 11/2015 | Yen et al. | |

* cited by examiner

HYBRID MICRO-DRIVER DISPLAY ARCHITECTURE
1700

HYBRID MICRO-DRIVER ARCHITECTURES HAVING TIME MULTIPLEXING FOR DRIVING DISPLAYS

RELATED APPLICATIONS

This patent application is a U.S. National Phase Application under 35 U.S.C. § 371 of International Application No. PCT/US2016/052954, filed Sep. 21, 2016, entitled HYBRID MICRO-DRIVER ARCHITECTURES HAVING TIME MULTIPLEXING FOR DRIVING DISPLAYS, which claims the benefit of priority of U.S. Provisional Application No. 62/233,247 filed Sep. 25, 2015, both of which are incorporated herein by reference.

BACKGROUND

Field

The disclosure relates generally to a display system, and, more specifically, to hybrid micro-driver architectures having time multiplexing for driving micro LED displays.

Background Information

Display panels are utilized in a wide range of electronic devices. Common types of display panels include active matrix display panels where each pixel may be driven to display a data frame. High-resolution color display panels, such as computer displays, smart phones, and televisions, may use an active matrix display structure. An active matrix display of m×n display (e.g., pixel) elements may be addressed with m row lines and n column lines or a subset thereof. In conventional active matrix display technologies a switching device and storage device is located at every display element of the display. A display element may be a light emitting diode (LED) or other light emitting material. A storage device(s) (e.g., a capacitor or a data register) may be connected to each display (e.g., pixel) element, for example, to load a data signal therein (e.g., corresponding to the emission to be emitted from that display element). The switches in conventional displays are usually implemented through transistors made of deposited thin films, and thus are called thin film transistors (TFTs). A common semiconductor used for TFT integration is amorphous silicon (a-Si), which allows for large-area fabrication in a low temperature process. A main difference between a-Si TFT and a conventional silicon metal-oxide-semiconductor-field-effect-transistor (MOSFET) is lower electron mobility in a-Si due to the presence of electron traps. Another difference includes a larger threshold voltage shift. Low temperature polysilicon (LTPS) represents an alternative material that is used for TFT integration. LTPS TFTs have a higher mobility that a-Si TFTs, yet mobility is still lower than for MOSFETs.

SUMMARY

Systems and apparatuses for hybrid micro-driver architectures having time multiplexing for driving displays are described. In one embodiment, a display (e.g., hybrid display architecture) includes a backplane and a micro-driver circuitry that is coupled to the backplane. The backplane includes circuitry (e.g., sample and hold circuitry) for sampling and holding analog data and for time multiplexing analog data. In one example, select logic time multiplexes analog data in a current domain. The micro-driver circuitry includes at least a capacitor of a ramp generator for generating a ramp voltage based on the analog data of the backplane and drive circuitry to cause at least one emission pulse for emitting a display element. In one example, each emission pulse has a pulse width that is based on a slope of the ramp voltage.

In one example, the circuitry (e.g., select logic) includes at least one transistor for each row of data to be time multiplexed from the backplane to the micro-driver circuitry. The circuitry (e.g., sample and hold circuitry) further includes a data scan switch and a capacitor for data storage for each row of data to be time multiplexed. The display (e.g., display architecture) further includes display circuitry (e.g., a light emitting diode (LED) circuitry, organic light emitting diode (OLED circuitry) having a plurality of display elements (e.g., LEDs, OLEDs). The display circuitry receives the at least one emission pulse from the drive circuitry with the at least one emission pulse being applied to one or more rows of display elements (e.g., LEDs, OLEDs).

In one example, the display circuitry shares a single pin with a selected column or color of display elements (e.g., LEDs, OLEDs) being selected based on time multiplexing. The drive circuitry includes a plurality of transistors for driving the emission pulses with a first transistor coupled to a first color of display elements (e.g., LEDs, OLEDs), a second transistor coupled to a second color of display elements (e.g., LEDs, OLEDs), and a third transistor coupled to a third color of display elements (e.g., LEDs, OLEDs).

In one example, the micro-driver circuitry further includes a plurality of switches with each switch being capable of selecting a row of display elements (e.g., LEDs, OLEDs) to be enabled for receiving the at least one emission pulse.

In another example, the TFT backplane further includes a plurality of switches with each being capable of selecting a row of display elements (e.g., LEDs, OLEDs) to be enabled for receiving the at least one emission pulse. The TFT backplane may include a plurality of switches coupled to anodes of display elements (e.g., LEDs, OLEDs) with a first group of the plurality of switches being capable of selecting a first row of display elements (e.g., LEDs, OLEDs) to be enabled for receiving the at least one emission pulse and a second group of the plurality of switches being capable of selecting a second row of display elements (e.g., LEDs, OLEDs) to be enabled for receiving the at least one emission pulse.

In one example, the backplane includes transistors to be implemented by at least one of Low Temperature Poly Silicon or oxide and the micro-driver circuitry includes a single crystalline silicon substrate.

In one example, each emission pulse has a pulse width that is a function of an analog input current provided by the backplane.

In another example, the ramp generator includes two control signals for selecting analog input data signals and for resetting the capacitor of the ramp generator.

In one embodiment, a display (e.g., display architecture) includes a backplane that is coupled to a micro-driver circuitry. The backplane includes circuitry (e.g., sample and hold circuitry) for sampling and holding analog input data signals and for time multiplexing data in a current domain, and a capacitor for generating a ramp voltage. In one example, select logic time multiplexes analog data in a current domain. The micro-driver circuitry generates drive current to cause at least one emission pulse with each emission pulse having a pulse width that is based on a slope of the ramp voltage.

In one example, the circuitry (e.g., select logic) includes at least one transistor for each row of data to be time multiplexed from the backplane to the micro-driver circuitry.

In another example, the display (e.g., display architecture) further includes a display circuitry (e.g., light emitting diode (LED) circuitry, OLED circuitry) having a plurality of light emitting diodes (LEDs). The display circuitry receives the at least one emission pulse from the micro-driver circuitry with the at least one emission pulse being applied to one or more rows of display elements. The display circuitry can share a single pin with a selected column or color of display elements being selected based on time multiplexing.

In another embodiment, a micro-driver circuitry includes a ramp generator having a capacitor for generating a ramp voltage based on analog input data to be time multiplexed in a current domain of a backplane. Drive circuitry is coupled to the ramp generator. The drive circuitry drives current to cause at least one emission pulse with each emission pulse having a pulse width that is based on a slope of the ramp voltage.

In one example, the micro-driver circuitry further includes select logic that is coupled to the capacitor. The select logic includes at least one transistor for each row of analog input data.

In one example, the drive circuitry generates drive current to cause at least one emission pulse to be applied to a display circuitry (e.g., LED circuitry, OLED circuitry) having a plurality of display elements (e.g., LEDs, OLEDs). The display circuitry receives the at least one emission pulse from the drive circuitry with the at least one emission pulse being applied to one or more rows of displays.

In another example, the drive circuitry causes at least one emission pulse to be applied to a single pin with a selected column or color of display elements being selected based on time multiplexing utilizing the single pin.

In another embodiment, a display panel includes a first plurality of display elements arranged in a first display row of the display panel and a first micro-driver arranged in a first row of micro-drivers adjacent and coupled to the first display row. The first micro-driver includes a first driving logic for driving a first color of the first plurality of display elements and a first select unit that is coupled to the first driving logic. The first select unit selects an output signal for driving a first color of a first display element or selects an output signal for driving a second color of a second display element of the first plurality of display elements. The display panel also include a second driving logic for driving a second color of the first plurality of display elements. A second select unit is coupled to the second driving logic. The second select unit selects an output signal for driving a third color of a third display element or selects an output signal for driving a first color of a fourth display element of the first plurality of display elements.

The first micro-driver further includes a third driving logic for driving a third color of the first plurality of display elements and a third select unit coupled to the third driving logic. The third select unit to select an output signal for driving a second color of a fifth display element or a third color of a sixth display element of the first plurality of display elements.

The display panel further includes a second micro-driver arranged in a second row of micro-drivers and a second plurality of display elements arranged in a second display row adjacent to the first and second rows of micro-drivers.

In one example, a pitch of the first and second rows of micro-drivers is approximately equal to a pitch of rows of the backplane. Each display element of the first plurality of display elements includes a first group of display elements. The first micro-driver is a first surface mounted micro-driver chip and the second micro-driver is a second surface mounted micro-driver chip.

BRIEF DESCRIPTION OF THE DRAWINGS

Embodiments are illustrated by way of example and not limitation in the Figures of the accompanying drawings.

DETAILED DESCRIPTION

Figure 1A:
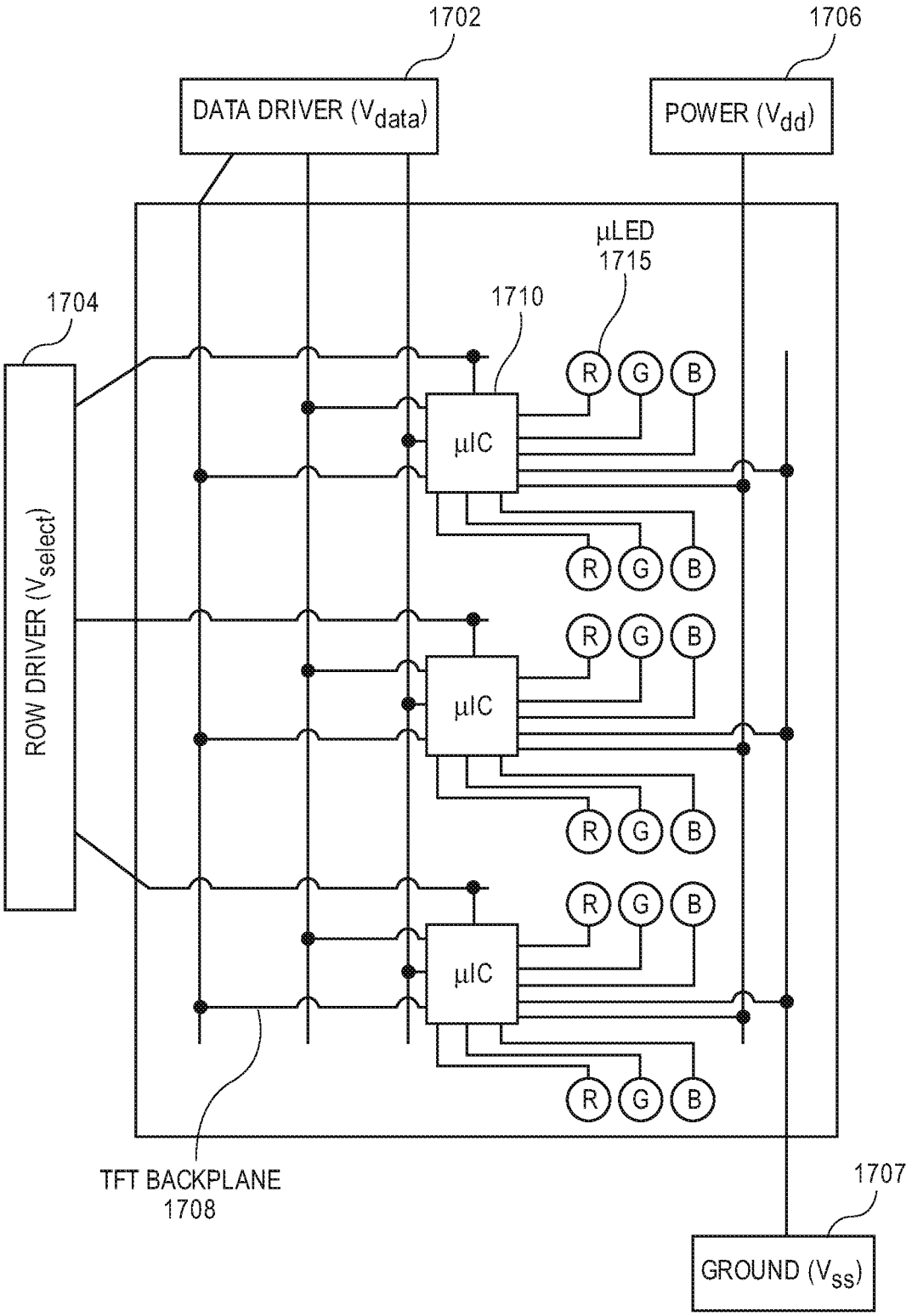
FIG. 1A is a block diagram of a hybrid micro-driver display architecture 1700, according to an embodiment.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. In other instances, well-known techniques and components have not been described in particular detail in order to not unnecessarily obscure the present disclosure. Reference throughout this specification to "one embodiment," "an embodiment", or the like means that a particular feature, structure, configuration, or characteristic described in connection with the embodiment is included in at least one embodiment of the disclosure. Thus, the appearances of the phrase "in one embodiment," "in an embodiment", or the like in various places throughout this specification are not necessarily referring to the same embodiment of the disclosure. Furthermore, the particular features, structures, configurations, or characteristics may be combined in any suitable manner in one or more embodiments.

The terms "over," "to," "between," and "on" as used herein may refer to a relative position of one layer with respect to other layers. One layer "over," or "on" another layer or bonded "to" another layer may be directly in contact with the other layer or may have one or more intervening layers. One layer "between" layers may be directly in contact with the layers or may have one or more intervening layers.

The term "ON" as used in this specification in connection with a device state refers to an activated state of the device, and the term "OFF" refers to a de-activated state of the device. The term "ON" as used herein in connection with a signal received by a device refers to a signal that activates the device, and the term "OFF" used in this connection refers to a signal that de-activates the device. A device may be activated by a high voltage or a low voltage, depending on the underlying electronics implementing the device. For example, a PMOS transistor device is activated by a low voltage while a NMOS transistor device is activated by a high voltage. Thus, it should be understood that an "ON" voltage for a PMOS transistor device and a NMOS transistor device correspond to opposite (low vs. high) voltage levels. It is also to be understood that where $V_{dd}$ and $V_{ss}$ is illustrated or described, it can also indicate one or more $V_{dd}$ and/or $V_{ss}$. For example, a digital $V_{dd}$ for can be used for data input, digital logic, memory devices, etc., while another $V_{dd}$ is used for driving the LED output block.

Methods, systems, and apparatuses for controlling an emission of the light emitting devices are described herein. In accordance with some embodiments, a hybrid LED driving circuit is described which is a hybrid arrangement of micro-driver (also referred to as μD or μDriver) chips and a TFT substrate which, in combination, are used to driver a set of light emitting devices such as, but not limited to micro LEDs (also referred to as μLEDs). Additionally, the hybrid LED driving circuit can use a hybrid of analog and digital driving techniques, in which an analog input voltage is used to control a digital pulse-width-modulation (PWM) driving scheme.

In an embodiment, a micro LED may be a semiconductor-based material having a maximum lateral dimension of 1 to 300 μm, 1 to 100 μm, 1 to 20 μm, or more specifically 1 to 10 μm, such as 5 μm. For example, a micro-driver chip may have a maximum lateral dimension of 1 to 300 μm, and may fit within the pixel layout of the micro LEDs. In accordance with embodiments, the μDriver chips can replace the switch (s) and storage device(s) for each display element as commonly employed in a TFT architecture. The μDriver chips may include digital unit cells, analog unit cells, or hybrid digital and analog unit cells. Additionally, MOSFET processing techniques may be used for fabrication of the μDriver chips on single crystalline silicon, in conjunction with TFT processing techniques on a-Si or LTPS.

The hybrid TFT and μDriver circuit can realize the benefits of μDriver circuit technology while reducing the overall size and number of inputs for each μDriver integrated circuit. The hybrid circuit can be created by offloading a portion of the transistors and capacitors utilized in existing μDriver circuits onto a display substrate, reducing the size and manufacturing cost of each μDriver circuit. Such hybrid approach, in some embodiments, may necessitate the use of traditional analog data driving. To implement emission control in hybrid TFT μDriver circuits, emission pulse width modulation (PWM) may be used, where the emission PWM is generated as a function of analog data voltage, allowing the use of traditional array driving approaches using SCAN and DATA lines coupled to the TFT display substrate in which switching transistors and capacitors on the TFT display substrate provide an analog input voltage to the μDriver circuit.

Hybrid TFT Micro-Driver Integrated Circuit Display Architecture and Overview

FIG. 1A is a block diagram of a hybrid micro-driver display architecture 1700, according to an embodiment. In one embodiment, the hybrid μDriver display architecture 1700 includes a data driver ($V_{data}$) 1702, row driver ($V_{select}$) 1704 inputs to control the display, as well as power ($V_{dd}$) 1706, and ground ($V_{ss}$) inputs 1707. A μDriver integrated circuit (IC) 1710 and one or more display elements 1715 (e.g., μLEDs 1715) are placed on a TFT backplane 1708 including switching transistors and capacitors to supply data to the μDriver IC 1710.

The μDriver IC 1710 includes drive transistors for the one or more μLEDs 1715 and can be fabricated separately from the TFT backplane 1708 in a crystalline Silicon wafer. The μDriver IC 1710 can be placed directly onto any active or passive TFT backplane and can interface with any type of LED, including organic LEDs (OLED). The μDriver IC 1710 can include a combination of any of the available MOS types required for implementing the driver (such as CMOS, all NMOS or all PMOS).

In this figure, and in the figures to follow, each illustrated LED device (e.g., μLED 1715) may represent a single LED device, or may represent multiple LED devices arranged in series, in parallel, or a combination of series and parallel. The LED devices can couple to a common ground or may each have a separate ground connection. The exemplary hybrid micro-driver display architecture 1700 illustrated shows three control inputs and six LED outputs, but embodiments are not so limited. A single μDriver IC 1710 can control multiple lighting emitting devices, where each lighting device has a separate analog input into the μDriver IC 1710.

In one embodiment, the μDriver IC 1710 couples with one or more red, green, and blue LED devices 1715 that emit different colors of light. In a red-green-blue (RGB) sub-pixel arrangement, each pixel includes three sub-pixels that emit red, green and blue lights, respectively. The RGB arrangement is exemplary and that embodiments are not so limited. Additional sub-pixel arrangements include, red-green-blue-yellow (RGBY), red-green-blue-yellow-cyan (RGBYC), or red-green-blue-white (RGBW), or other sub-pixel matrix schemes where the pixels may have a different number of sub-pixels, such as the displays manufactured under the trademark name PenTile®.

In one embodiment, each sub-pixel circuit driver in the μDriver IC 1710 is responsible for providing operating current for illumination to each individual LED. Thus, the circuitry for each sub-pixel circuit can be designed specifically for each LED, allowing the switching transistors in the backplane to be implemented by any combination of LTPS (Low Temperature Poly Silicon) and/or Oxide (e.g., IGZO or Indium Gallium Zinc Oxide) TFTs to ensure low leakage devices, while the technology of the μDriver IC 1710 is independent of the backplane. The independent backplane and μDriver IC 1710 enable the production of low voltage devices having higher mobilities. The higher mobilities of the driving circuit devices provide higher currents to the LEDs, resulting in reduced maximum rail voltages for reduced power consumption while maintaining minimum geometry transistors. The smaller geometry transistors enable the circuit to operate at higher speeds with lower parasitic losses, as the circuit occupies a smaller area. The size of the μDriver IC 1710, in one embodiment is 50 μm wide by 24 μm long. However, the size of each μDriver IC 1710 generally depends on the number of sub-pixel circuit drivers the μDriver IC 1710 contains.

Figure 1B:
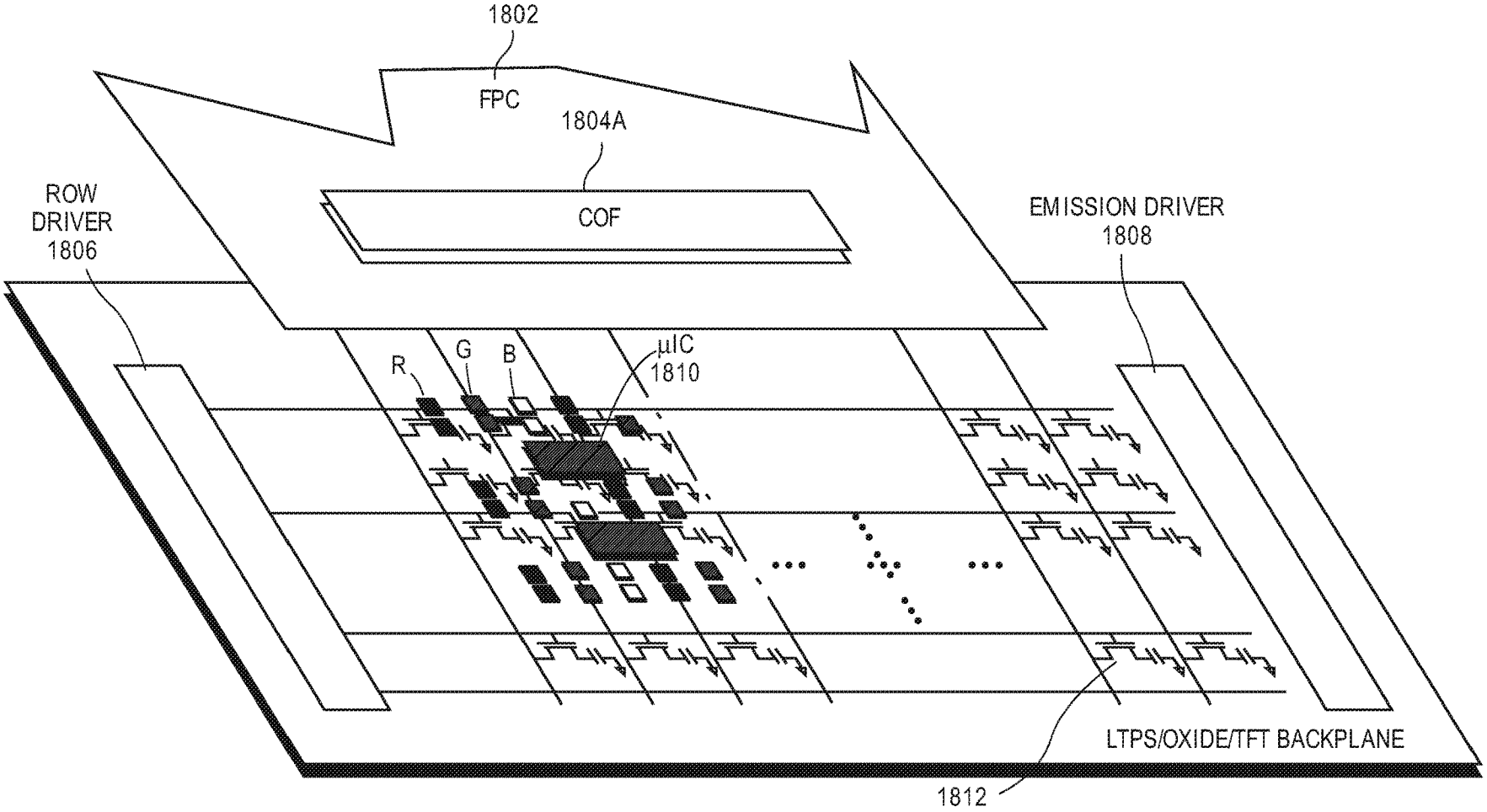
FIGS. 1B-1C are block diagrams illustrating different views of an additional backplane-driver design, according to an embodiment.
Figure 1C:
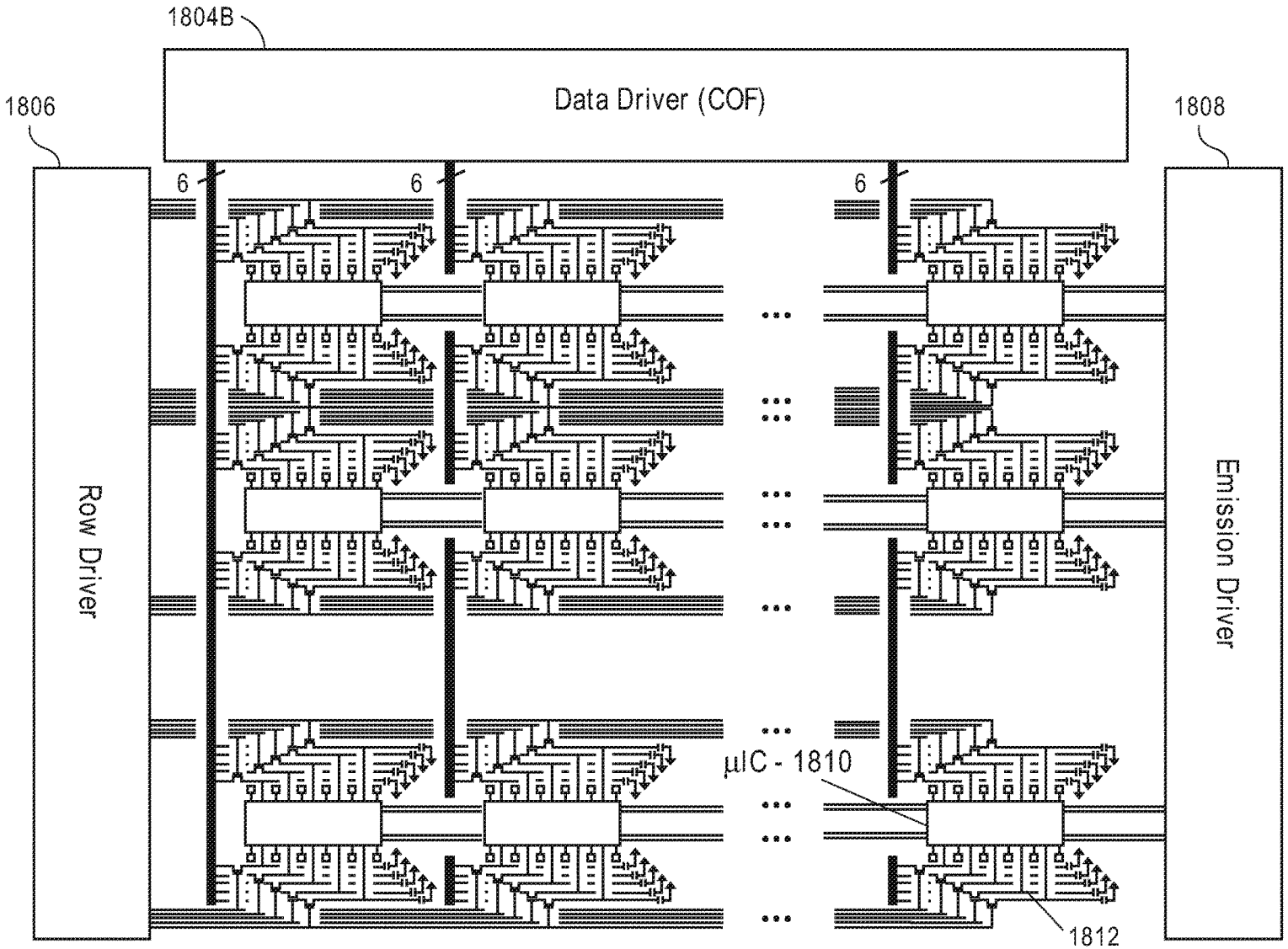

FIGS. 1B and 1C are block diagrams illustrating different views of an additional backplane-driver design, according to an embodiment. FIG. 1B illustrates an exemplary backplane driver design having a flexible printed circuit (FPC) and a chip on flex (COF) circuit. FIG. 1C illustrates a top-down view of the exemplary backplane driver design.

As illustrated in FIG. 1B, the backplane-driver design includes an FPC 1802 coupled to an LTPS/Oxide TFT backplane 1812. The FPC 1802 can include a COF circuit 1804A, which is an integrated circuit coupled to the FPC 1802. In one embodiment, a row driver 1806 and an emission driver 1808 couple to a TFT backplane 1812, which may be an LTPS/Oxide TFT backplane. The TFT backplane 1812 includes a sample and hold circuit having at least one transistor and one capacitor, although other sample and hold circuits may be used. A μDriver IC 1810 couples to the TFT backplane 1812 and a set of one or more light emitting devices (e.g., R, G, and B LEDs), where multiple light emitting devices can couple to a single μDriver IC 1810.

FIG. 1C illustrates a top-down view of the exemplary backplane driver design, where the row driver 1806 and emission driver 1808 are illustrated as coupled to the TFT backplane 1812 in conjunction with a data driver 1804B, which may be included in the COF circuit 1804A shown in FIG. 1B. In one embodiment, the data driver 1804B supplies pixel data values before the lighting elements are signaled for emission by the emission driver 1808. The pixel data values are stored in capacitors selected by the row driver 1806. After each line has been programmed with data, the emission driver 1808 is responsible for sending the input to cause the illumination of the lighting elements for a pixel. In the illustrated display architecture, the data driver 1804B controls the grey levels of the pixels and the emission driver 1808 controls the brightness.

While the backplane driver architecture illustrated uses an active TFT matrix, in one embodiment, a passive matrix is employed, for example, when operational frequencies exceed the operational limits of the TFT backplane due to the low mobilities inherent in some TFT technologies. In a passive TFT matrix architecture, row and emission driving can be realized with a chain of μDriver ICs 1710 (or 1810) interconnected over a passive TFT backplane.

Figure 1D:
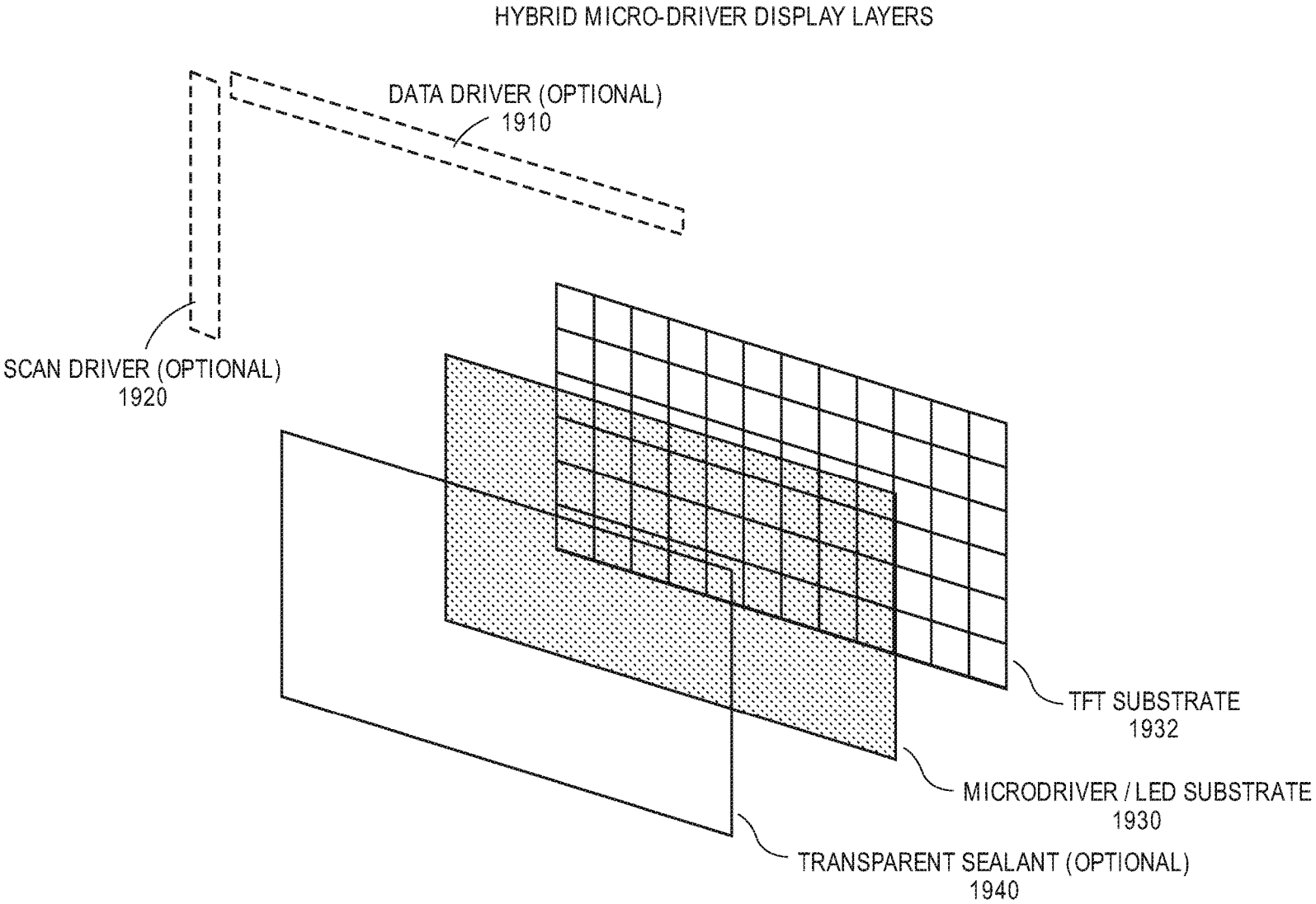
FIG. 1D is an illustration of a hybrid micro-driver display, according to an embodiment.

FIG. 1D is an illustration of a hybrid micro-driver display, according to an embodiment. In one embodiment, a μDriver and LED substrate 1930 that is prepared with distribution lines to interconnect a micro-matrix of μDriver IC devices and LEDs (e.g., μLEDs, OLEDs, etc. In one embodiment a TFT substrate 1932 including LTPS and/or Oxide transistors and capacitors are deposited or integrated with the μDriver/LED substrate 1930. An optional sealant 1940 can be used to secure and protect the substrate. In one embodiment, the sealant is transparent, to allow a display or lighting substrate with top emission LED devices to display through the sealant. In one embedment, the sealant is opaque, for use with bottom emission LED devices. In one embodiment an optional a data driver 1910 and a scan driver 1920 couple with multiple data and scan lines on the display substrate. In one embodiment, each of the smart-pixel devices couple with a refresh and timing controller 1924. The refresh and timing controller 1924 can address each LED device individually, to enable asynchronous or adaptively synchronous display updates. In one embodiment, an emission controller 1926 can couple with the μDriver/LED substrate 1930 to control the brightness of LEDs, for example, via manipulation of emission control inputs. In one embodiment the emission controller 1926 can couple with one or more optical sensors to allow adaptive adjustment of emission pulse length based on ambient light conditions. In one embodiment the emission controller 1926 can adjust display brightness via manipulation of reference voltages supplied to the μDrivers.

A display system may include a receiver to receive display data from outside of the display system. The receiver may be configured to receive data wirelessly, by a wire connection, by an optical interconnect, or any other connection. The receiver may receive display data from a processor via an interface controller. In one embodiment, the processor may be a graphics processing unit (GPU), a general-purpose processor having a GPU located therein, and/or a general-purpose processor with graphics processing capabilities. The display data may be generated in real time by a processor executing one or more instructions in a software program, or retrieved from a system memory. A display system may have any refresh rate, e.g., 50 Hz, 60 Hz, 100 Hz, 120 Hz, 200 Hz, or 240 Hz.

Depending on its applications, a display system may include other components. These other components include, but are not limited to, memory, a touch-screen controller, and a battery. In various implementations, the display system may be a television, smart watch, wearable device, tablet, phone, laptop, computer monitor, automotive heads-up display, automotive navigation display, kiosk, digital camera, handheld game console, media display, ebook display, or large area signage display.

Figure 2:
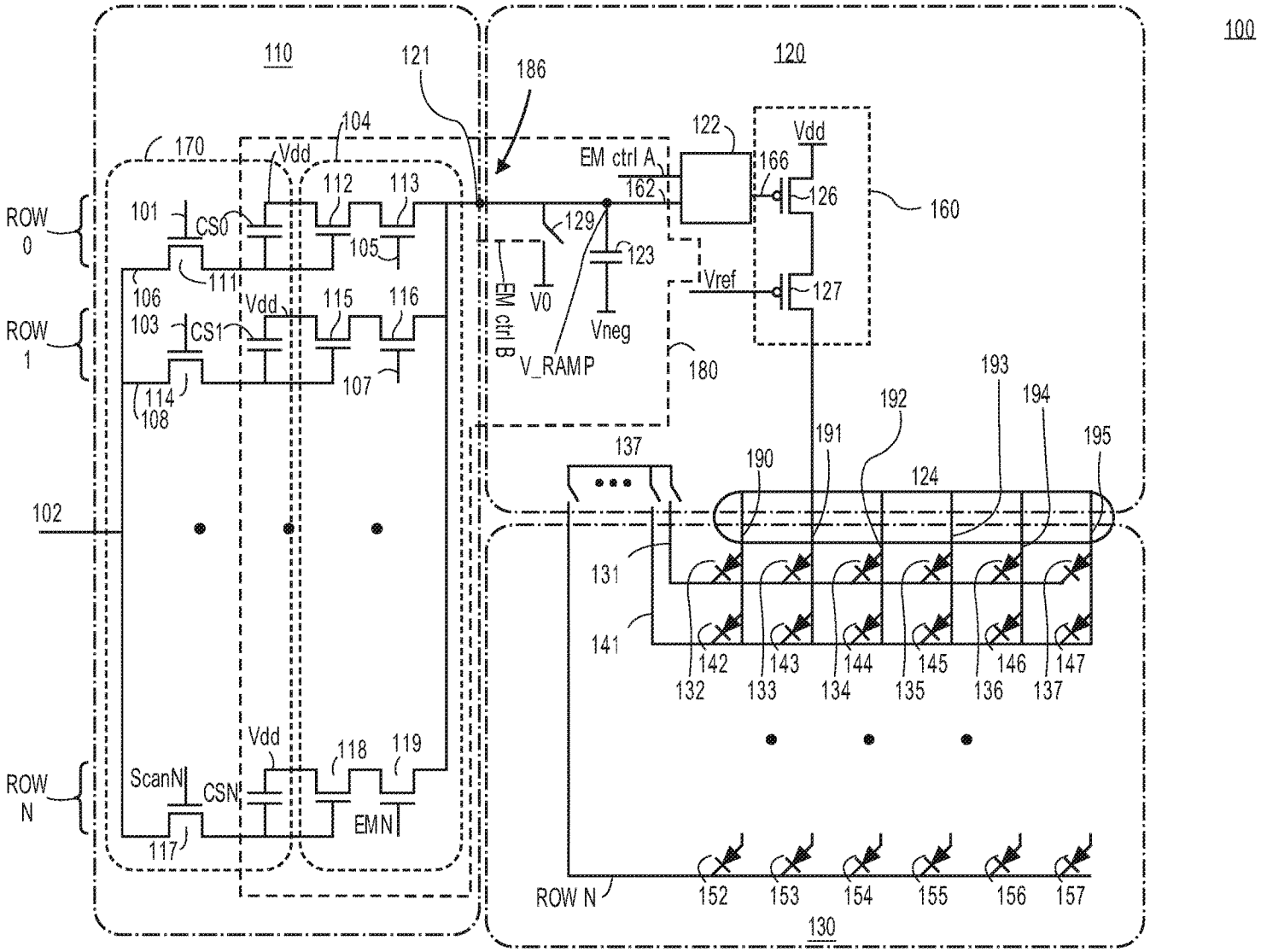
FIG. 2 is a block diagram of a hybrid micro-driver display architecture 100, according to one embodiment.

FIG. 2 is a block diagram of a hybrid micro-driver display architecture 100, according to one embodiment. In one embodiment, the hybrid μDriver display architecture 100 includes a backplane 110 and a micro-driver 120. The backplane 100 includes sample and hold circuitry 170 and select circuitry 104 (e.g., select logic, multiplexer) for selecting input data signals 102 (e.g., data signals 106, 108, . . . N) and generating output signals at output node 121 that have been multiplexed in a current domain with multiple rows (row 0, row 1, . . . row N) of the circuitry 170 and select circuitry 104 to generate the multiplexed output signals at output node 121. In one example, row 0 of sample and hold circuitry includes a data scan transistor 111 and a data storage capacitor CS 0 while row 0 of select circuitry includes a transistor 112 and a transistor 113. In a similar manner, row 1 of circuitry 170 includes a data scan transistor 114 and a data storage capacitor CS 1 while select circuitry 104 includes a transistor 115 and a transistor 116 having an EM 107 input applied to a gate terminal. One or more additional rows can be included in this design including a row N having a data scan transistor 117, a data storage capacitor CS N, a transistor 118, and a transistor 119.

In one embodiment, the select circuitry 104 selects a data signal 106 from row 0 by enabling the scan transistor 111 with scan 101 signal to pass the data signal 106 to the data storage capacitor CS 0, which samples the data signal 106 and holds a value for the data signal 106. A voltage to current conversion occurs in which transistor 112 generates a current. A current flows through transistor 113 and becomes an output value of the select circuitry 104 if the transistors 112 and 113 are both enabled (e.g., enabled to have conductive channels). An emission signal EM 105 can be applied to a gate terminal of the transistor if desired for enabling or disabling the transistor 113. Other rows can be selected at a different time if desired for selecting a data signal for a particular row. In this manner, the select circuitry 104 performs analog multiplexing in the current domain to select a data signal from one of the rows and generate an output signal with a single shared pad at time multiplexed region 186. Multiplexing in a current domain prevents charge sharing between data storage capacitors (CS0, CS1, etc.).

The micro-driver (μDriver) integrated circuit (IC) 120 includes, emission logic 122 (e.g., OR logic, comparator), drive circuitry 160 (e.g., transistor 126, transistor 127), and a ramp signal generator 180 that includes a switch 129 that receives an emission control signal (e.g., EM control B signal), a ramp capacitor 123, and optionally transistors (e.g., transistors of the select circuitry 104) for generating a current for the ramp signal generator. The ramp signal generator may also include data storage capacitors CS0, CS1, . . . CSN. The emission logic 122 may include similar functionality as emission logic 622 of FIG. 7A. The select circuitry 104 generates output signals at output node 121. The drive circuitry 160 couples to display circuitry 130 having display elements (e.g., LEDs, OLEDs) and drives current to rows (e.g., row 131, row 141, row N) of standard LED, organic LED, or any other type of current driven light emitting devices. Each row of the display circuitry 130 corresponds to a row of the circuitry 170 and select circuitry 104. In one example, the display circuitry 130 (e.g., micro-LED array) includes 3 rows and 6 columns of LEDs (also referred to as LED devices.) In another example, the micro-LED array 130 includes 6 rows and 6 columns of LED devices. The emission logic 122 may include OR logic and/or a comparator arranged in a similar manner in comparison to emission logic 622 of FIG. 7A. The emission logic 122 generates an output signal 166 based on receiving an input 162 from the ramp generator and an emission control signal, EM control A.

An exemplary drive cycle for the PWM drive circuitry 160 (e.g., PWM LED, PWM OLED) is as follows. Upon assertion of a scan input (e.g., scan 101, scan 103, . . . scan N) to the sample and hold circuitry 170, an input data voltage of a data signal 102 is applied to a scan transistor and a data storage capacitor samples a selected data signal and holds a value for the data signal. A voltage to current conversion occurs in which a transistor of the select circuitry 104 generates a current. A current flows through a coupled transistor in a row of the select circuitry and becomes an output value of the select circuitry.

In the micro-driver 120, in one example, the emission control signal A which is coupled to the emission logic 122 can be asserted (e.g., triggers high) to ensure that emission is not enabled, keeping the display circuitry 130 from emitting. The emission control signal B may also trigger high (or low) to couple V_ramp node to V0. Ramp generation begins when emission control signal B is de-asserted and current charges the ramp generator. Charging the ramp generator generates a ramp voltage (e.g., V_Ramp), the slope of which is a function of the applied data voltage.

In one embodiment, actual emission of a selected row of display circuitry (e.g., micro-LED array) is moderated by emission control signal A, and emission does not begin until de-assertion of the emission control signal A triggers emission enable. The sub-pixel circuits can be configured such that all sub-pixels in a row start emission at the same time. At emission enable, a selected row of the display circuitry 130 will begin to emit based on current supplied by the drive circuitry 160, which is determined in part by the voltage ($V_{ref}$) supplied to transistor 127.

At the emission logic 122 (e.g., comparator, emission logic 622), in one example, the ramp voltage (V_ramp) and a reference voltage are compared, for example, with a comparator. The reference voltage to which the ramp voltage is compared defines the threshold in which the comparator will trip. When the ramp voltage becomes equal to the reference voltage, the comparator trips, generating an output signal (or change in output signal) supplied to OR logic (e.g., OR gate) along with EM control A. In one example, the OR logic outputs a signal to pull the EM signal 166 high and disables emission by disabling the current flow to the display circuitry 130 from the drive circuitry. Accordingly, a pulse width of an emission pulse is a function of applied data voltage.

The reference voltage ($V_{ref}$) supplied to transistor 127 controls the final current through the display circuitry 130. Each of the reference voltages of the emission logic 122 and ($V_{ref}$) can be adjusted for dimming control. In one example, the emission control signal A maintains EM signal 166 high to disable emission completely for black level. Accordingly, emission control signal A may be enabled before emission control signal B and remain high until after output of the comparator becomes high if the subpixel is intended to emit a completely black level. The switch 137 (e.g., Vneg switch) is utilized for selecting a row of display elements to be emitted. The display elements (e.g., anode of micro-LEDs) share a pad in the time multiplexed region 124 in order to reduce a number of pads (or pins). The output signals from the select circuitry 104 also share a pad (e.g., ramp generator pad) at output node 121 in the time multiplexed region 186 in order to reduce a number of pads. In another embodiment, time multiplexing occurs in a different manner (e.g., column based, color based).

The micro-driver (μDriver) integrated circuit (IC) 120 includes drive transistors for the one or more micro-LEDs (μLEDs) 130 and can be fabricated separately from the backplane 120 (e.g., TFT backplane 120) in a single crystal Silicon substrate. The μDriver IC 120 can be placed directly onto any active or passive TFT backplane and can interface with any type of LED, including organic LEDs (OLED). The μDriver IC 120 can include a combination of any of the available CMOS types required for implementing the driver (such as CMOS, all NMOS or all PMOS).

In this figure, and in the figures to follow, each illustrated display element (e.g., display elements 132-137, 142-147, 152-157) may represent a single display element device, or may represent multiple display element devices arranged in series, in parallel, or a combination of series and parallel. The display element devices (e.g., LEDs, OLEDs) can couple to a common ground or may each have a separate ground connection. The exemplary hybrid micro-driver display architecture 100 illustrated shows various control inputs and an array of LED outputs, but embodiments are not so limited. A single μDriver IC 120 can control multiple lighting emitting devices, where each lighting device has a separate analog input (e.g., data signals 102) into the μDriver IC 120.

In one embodiment, the μDriver IC 100 couples with one or more red, green, and blue LED devices that emit different colors of light. In a red-green-blue (RGB) sub-pixel arrangement, each pixel includes three sub-pixels that emit red, green and blue lights, respectively. The RGB arrangement is exemplary and that embodiments are not so limited. Additional sub-pixel arrangements include, red-green-blue-yellow (RGBY), red-green-blue-yellow-cyan (RGBYC), or red-green-blue-white (RGBW), or other sub-pixel matrix schemes where the pixels may have a different number of sub-pixels, such as the displays manufactured under the trademark name PenTile®. In one example, columns 190 and 193 include a first color of LED devices, columns 191 and 194 include a second color of LED devices, and columns 192 and 195 include a third color of LED devices.

In one embodiment, the smart-pixel micro-matrix is used in LED lighting solutions, or as an LED backlight for an LCD device. When used as a light source, blue or UV LEDs in combination with a yellow or blue-yellow phosphor may be used to provide a white backlight for LCD displays. In one embodiment, a smart-pixel micro-matrix using one or more blue LED devices, such as an indium gallium nitride (InGaN) LED device, is combined with the yellow luminescence from cerium doped yttrium aluminum garnet ($YAG:Ce^{3+}$) phosphor. In one embodiment, red, green, and blue phosphors are combined with a near-ultraviolet/ultraviolet (nUV/UV) InGaN LED device to produce white light. The phosphor can be bonded to the surface of the LED device, or a remote phosphor can be used. In addition to white light emission, additional red, green and/or blue LED device can also be used to provide a wider color gamut than otherwise possible with white backlights.

In one embodiment, each sub-pixel circuit driver in the μDriver IC 120 is responsible for providing operating current for illumination to each individual LED. Thus, the circuitry for each sub-pixel circuit can be designed specifically for each LED, allowing the switching transistors in the backplane to be implemented by any combination of LTPS (Low Temperature Poly Silicon) and/or Oxide (e.g., IGZO or Indium Gallium Zinc Oxide) TFTs to ensure low leakage devices, while the technology of the μDriver IC 120 is independent of the backplane. The independent backplane and μDriver IC 120 enable the production of low voltage devices having higher mobilities. The higher mobilities of the driving circuit devices provide higher currents to the LEDs, resulting in reduced maximum rail voltages for reduced power consumption while maintaining minimum geometry transistors. The smaller geometry transistors enable the circuit to operate at higher speeds with lower parasitic losses, as the circuit occupies a smaller area. The size of the μDriver IC 120, in one embodiment is 50 μm wide by 24 μm long. However, the size of each μDriver IC 1710 generally depends on the number of sub-pixel circuit drivers the μDriver IC 1710 contains.

In one example, the backplane 100 includes hardware (e.g., 1 capacitor for data storage, data scan transistor, multiplexing transistor, switch transistor) for each row of input data and corresponding row of display elements of the display circuitry 130. In one example, the capacitor uses approximately 900 $microns^2$ and each transistor uses approximately 150 $microns^2$.

In another example, the display circuitry 130 includes 12 LED devices and N rows. A number of pins for different examples of N (e.g., 1, 2, 4, 6) follows below in Table 1 with x being a total number of pins for N=1:

| Pin Name | # Pins (N = 1) | # Pins (N = 2) | # Pins (N = 4) | # Pins (N = 6) | Shared/ Global |
|---|---|---|---|---|---|
| uLED | 12 | 12 | 12 | 12 | Shared |
| Ramp | 12 | 12 | 12 | 12 | Shared |
| EM_Ctrl A | 1 | 1 | 1 | 1 | Global |
| Vneg switch | 0 | 2 | 4 | 6 | |
| Total | x | x + 3 | x + 6 | x + 9 | — |

Thus, a larger number of rows to be time multiplexed results in less area and cost, less duty cycle for 2000 nits, and more current resistance (IR) drop artifacts. Thus, the design has a tradeoff between cost and display performance. N (e.g., 2, 3, 4) can be designed to optimize this tradeoff for a particular type of display device (e.g., smart watch, smart phone, tablet device, computing device, smart TV, etc.).

Figure 3:
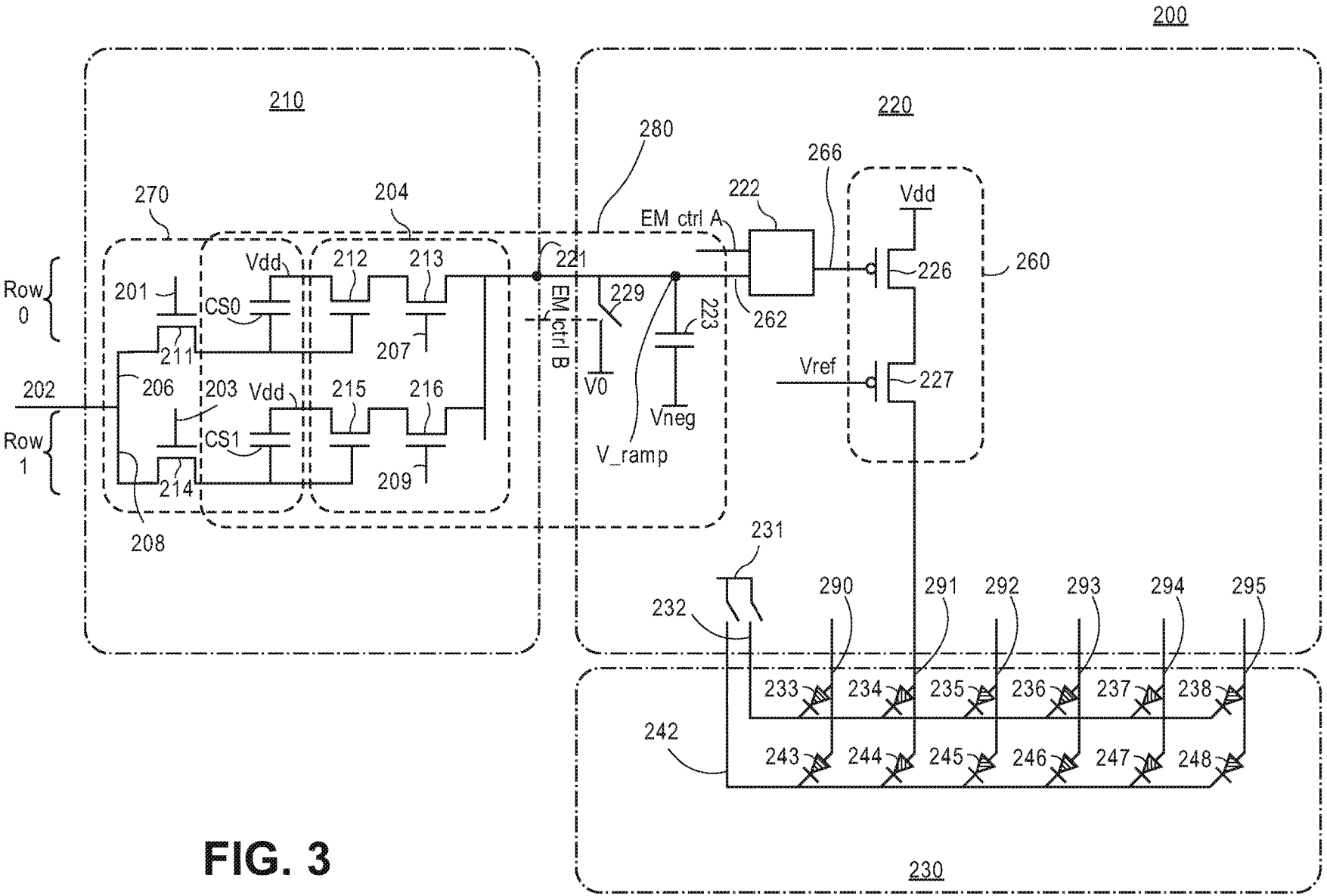
FIG. 3 is a block diagram of a hybrid micro-driver display architecture 200, according to one embodiment.

FIG. 3 is a block diagram of a hybrid micro-driver display architecture 200, according to one embodiment. In one embodiment, the hybrid μDriver display architecture 200 includes similar components and functionality as discussed in conjunction with display architecture 100. The display architecture 200 includes a backplane 210 and a micro-driver 220. The backplane 210 includes sample and hold circuitry 270 and select circuitry 204 (e.g., select logic, multiplexer) for selecting input data signals 202 (e.g., data signals 206, 208) and generating output signals at output node 221 that have been multiplexed in a current domain with multiple rows (row 0, row 1) of the circuitry 270 and select circuitry 204 to generate the multiplexed output signals at output node 221. In one example, row 0 of sample and hold circuitry includes a data scan transistor 211 and a data storage capacitor CS 0 while row 0 of select circuitry includes a transistor 212 and a transistor 213. In a similar manner, row 1 of circuitry 270 includes a data scan transistor 214 and a data storage capacitor CS 1 while select circuitry 204 includes a transistor 215 and a transistor 216.

In one embodiment, the select circuitry 204 selects a data signal 206 from row 0 by enabling the scan transistor 211 with scan 201 signal to pass the data signal 206 to the data storage capacitor CS 0, which samples the data signal 2060 and holds a value for the data signal 206. A voltage to current conversion occurs in which transistor 212 generates a current. A current flows through transistor 213 and becomes an output value of the select circuitry 204 if the transistors 212 and 213 are both enabled (e.g., enabled to have conductive channels). An emission signal EM 207 can be applied to the transistor if desired for enabling or disabling the transistor 213. Other rows can be selected at a different time if desired for selecting a data signal for a particular row. In this manner, the select circuitry 204 performs analog multiplexing in the current domain to select a data signal and generate an output signal with a single shared pin or pad.

The micro-driver (μDriver) integrated circuit (IC) 220 includes emission logic 222 (e.g., OR logic, comparator), drive circuitry 260 (e.g., transistor 226, transistor 227), and a ramp signal generator 280 that includes a switch 229 that receives an emission control signal (e.g., EM control B signal), a ramp capacitor 223, and transistors (e.g., transistors of the select circuitry 204) for generating a current for the ramp signal generator. The ramp signal generator may also include data storage capacitors CS0 and CS1. The emission logic 222 may include similar functionality in comparison to emission logic 622 of FIG. 7A. The ramp signal generator 280 receives input from the circuitry 270, the transistors of the select circuitry 204 receive this input and generate output signals at output node 221, and the drive circuitry 260 couples to and drives current for an attached display circuitry 230 having rows 232 and 242 of standard LED, organic LED, or another current driven light emitting devices. Each row of the display circuitry 230 corresponds to a row of the circuitry 270 and select circuitry 204. In one example, the display circuitry 130 includes 2 rows and 6 columns of LED devices. The emission logic 222 may include OR logic and/or a comparator. The emission logic 222 generates an output signal based on receiving a first input 262 from the ramp generator and a second input signal is an emission control signal, EM control A.

An exemplary drive cycle for the PWM drive circuitry 260 is as follows. Upon assertion of a scan input (e.g., scan 201, scan 203) to the sample and hold circuitry 270, an input data voltage of a data signal 202 is applied to a scan transistor and a data storage capacitor samples a selected data signal and holds a value for the data signal. A voltage to current conversion occurs in which a transistor of the select circuitry 204 generates a current. A current flows through a coupled transistor in a row of the select circuitry and becomes an output value of the select circuitry.

In the micro-driver 220, the emission control signal A which is coupled to the emission logic 222 is asserted (e.g., triggers high) to ensure that EM 266 is not enabled, keeping the display circuitry 230 from emitting. The emission control signal B may also triggers high (or low) to couple V_ramp node to V0. In one example, ramp generation begins when emission control A is de-asserted and current charges the ramp generator. Charging the ramp generator generates a ramp voltage (V_ramp), the slope of which is a function of the applied data voltage.

In one embodiment, actual emission of a selected row of display circuitry 230 is moderated by emission control signal A, and emission does not begin until de-assertion of the emission control signal A triggers emission enable. The sub-pixel circuits can be configured such that all sub-pixels in a row start emission at the same time. At emission enable, selected row of the display circuitry array will begin to emit based on current supplied by the drive circuitry 260, which is determined in part by the voltage ($V_{ref}$) supplied to transistor 227.

At the emission logic 222 (e.g., comparator, emission logic 622), in one example, the ramp voltage (V_ramp) and a reference voltage are compared, for example, with a comparator. The reference voltage to which the ramp voltage is compared defines the threshold in which the comparator will trip. When the ramp voltage becomes equal to the reference voltage, the comparator trips, generating an output signal (or change in output signal) supplied to OR logic (e.g., OR gate) along with EM control A. In one example, the OR logic outputs a signal to pull the EM signal 266 high and disables emission by disabling the current flow to the display circuitry 230 from the drive circuitry. Accordingly, the LED pulse width is function of applied data voltage.

The reference voltage ($V_{ref}$) supplied to transistor 227 controls the final current through the display element. The switch 231 (e.g., Vneg switch) is utilized for selecting a row of display elements to be emitted. The display elements (e.g., anode of micro-LEDs) share a pin or pad in order to reduce a number of pins or pads. The output signals from the select circuitry 204 also share a pin (e.g., ramp generator pin) or pad at output node 221 in order to reduce a number of pins or pads. In another embodiment, time multiplexing occurs in a different manner (e.g., column based, color based).

In this figure, and in the figures to follow, each illustrated display element device (e.g., μLED 233-238, 243-248) may represent a single display element device, or may represent multiple display element devices arranged in series, in parallel, or a combination of series and parallel. The display element devices can couple to a common ground or may each have a separate ground connection. The exemplary hybrid micro-driver display architecture 200 illustrated shows various control inputs and an array of LED outputs, but embodiments are not so limited. A single μDriver IC 220 can control multiple lighting emitting devices, where each lighting device has a separate analog input (e.g., data signals 202) into the μDriver IC 220.

In one embodiment, the μDriver IC 200 couples with one or more red, green, and blue LED devices that emit different colors of light. In one example, columns 290 and 293 include a first color of LED devices, columns 291 and 2194 include a second color of LED devices, and columns 292 and 295 include a third color of LED devices.

Figure 4:
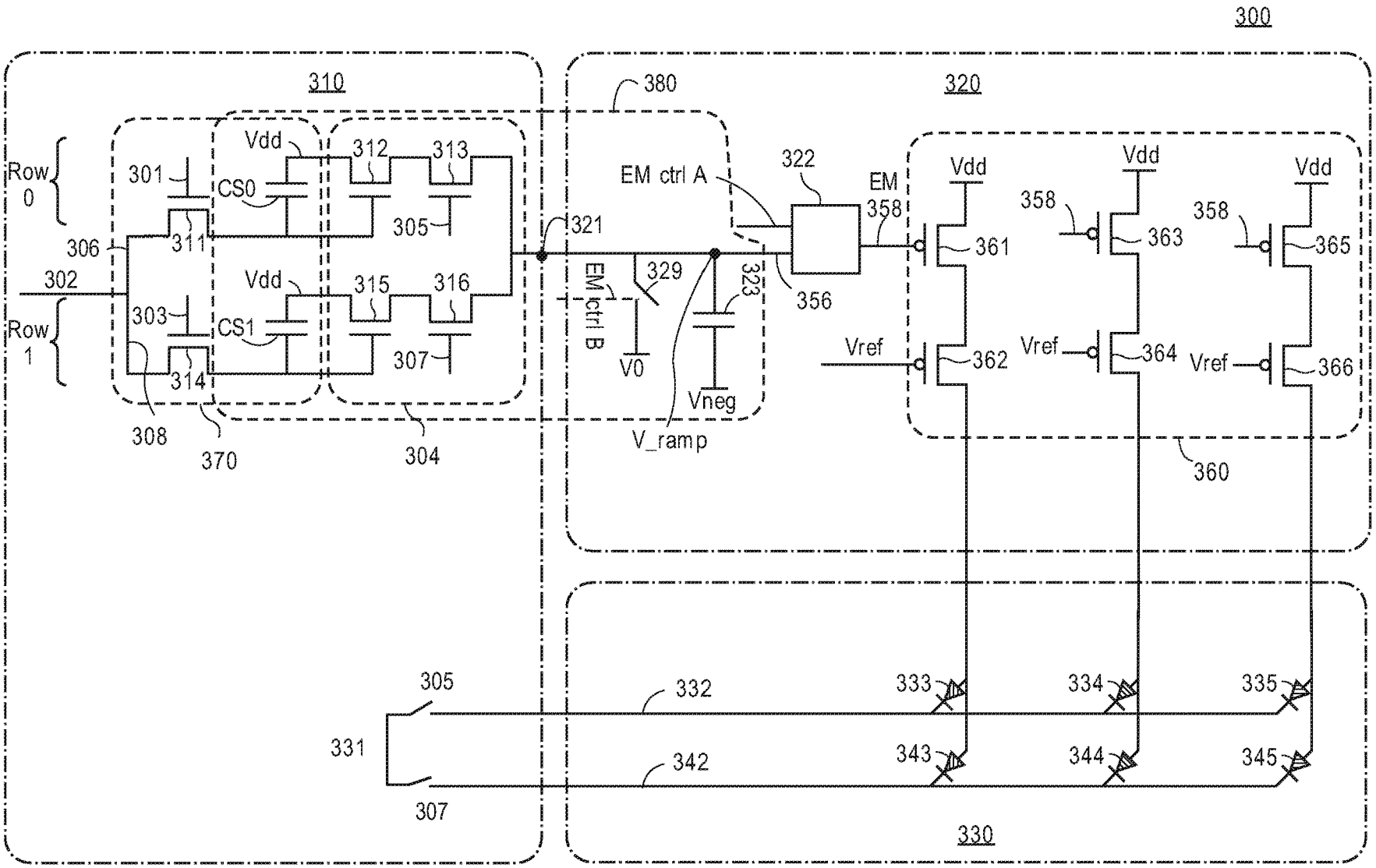
FIG. 4 is a block diagram of a hybrid micro-driver display architecture 300, according to one embodiment.

FIG. 4 is a block diagram of a hybrid micro-driver display architecture 300, according to one embodiment. In one embodiment, the hybrid μDriver display architecture 300 includes similar components and functionality as discussed in conjunction with display architecture 200. The display architecture 300 includes a backplane 310 and a micro-driver 320. The backplane 300 includes sample and hold circuitry 370 and select circuitry 304 (e.g., select logic, multiplexer) for selecting input data signals 302 (e.g., data signals 0, 1) and generating output signals at output node 321 that have been multiplexed in a current domain with multiple rows (row 0, row 1) of the circuitry 370 and select circuitry 304 to generate the multiplexed output signals at output node 321. In one example, row 0 of sample and hold circuitry includes a data scan transistor 311 and a data storage capacitor CS 0 while row 0 of select circuitry includes a transistor 312 and a transistor 313. In a similar manner, row 1 of circuitry 370 includes a data scan transistor 314 and a data storage capacitor CS 1 while select circuitry 304 includes a transistor 315 and a transistor 316.

In one embodiment, the select circuitry 304 selects a data signal 306 from row 0 by enabling the scan transistor 311 with scan 301 signal to pass the data signal 306 to the data storage capacitor CS 0, which samples the data signal 306 and holds a value for the data signal 306. A voltage to current conversion occurs in which transistor 312 generates a current. A current (e.g., current 0) flows through transistor 313 and becomes an output value of the select circuitry 304 if the transistors 312 and 313 are both enabled (e.g., enabled to have conductive channels). An emission signal EM 305 can be applied to the transistor if desired for enabling or disabling the transistor 313. Other rows can be selected at a different time if desired for selecting a data signal for a particular row. In this manner, the select circuitry 304 performs analog multiplexing in the current domain to select a data signal and generate an output signal with a single shared pin or pad. Multiplexing in a current domain prevents charge sharing between data storage capacitors.

The micro-driver (μDriver) integrated circuit (IC) 320 includes emission logic 322 (e.g., OR logic, comparator), drive circuitry 360 (e.g., transistors 361-366), and a ramp signal generator 380 that includes a switch 329 that receives an emission control signal (e.g., EM control B signal), a ramp capacitor 323, and transistors (e.g., transistors of the select circuitry 304) for generating a current for the ramp signal generator. The ramp signal generator may also include data storage capacitors CS0 and CS1. The ramp signal generator 380 receives input from the circuitry 370, the transistors of the select circuitry 304 receive this input and generate output signals at output node 321, and the drive circuitry 360 couples to and drives current to display circuitry 330 having rows 332 and 342 of display elements, standard LED, organic LED, or another current driven light emitting devices. Each row of the micro-LED array 330 corresponds to a row of the circuitry 370 and select circuitry 304. In one example, the micro-LED array 230 includes 2 rows and 3 columns of LED devices. The emission logic 322 may include OR logic and/or a comparator. The emission logic 322 generates an output signal 358 based on receiving a first input 356 from the ramp generator and a second input signal is an emission control signal EM control A.

An exemplary drive cycle for the PWM LED driving circuitry 360 is as follows. Upon assertion of a scan input (e.g., scan 301, scan 303) to the sample and hold circuitry 370, an input data voltage of a data signal 302 is applied to a scan transistor and a data storage capacitor samples a selected data signal and holds a value for the data signal. A voltage to current conversion occurs in which a transistor of the select circuitry 304 generates a current. A current flows through a coupled transistor in a row of the select circuitry and becomes an output value of the select circuitry.

In the micro-driver 320, the emission control signal A which is coupled to the emission logic 322 is asserted (e.g., triggers high) to ensure that EM 358 is not enabled, keeping the display circuitry 330 from emitting. The emission control signal B may also triggers high (or low) to couple V_Cst node to V0. Ramp generation begins when emission control A is de-asserted and current charges the ramp generator. Charging the ramp generator generates a ramp voltage (V_ramp), the slope of which is a function of the applied data voltage.

In one embodiment, actual emission of a selected row of micro-LED array is moderated by emission control signal A, and emission does not begin until de-assertion of the emission control signal A triggers emission enable. The sub-pixel circuits can be configured such that all sub-pixels in a row start emission at the same time. At emission enable, a selected row of the display circuitry will begin to emit based on current supplied by the drive circuitry 360, which is determined in part by the voltage ($V_{ref}$) supplied to transistors 362, 364, and 366.

At the emission logic 322 (e.g., comparator, emission logic 622), the ramp voltage (V_ramp) and a reference voltage are compared, for example, with a comparator. The reference voltage to which the ramp voltage is compared defines the threshold in which the comparator will trip. When the ramp voltage becomes equal to the reference voltage, the comparator trips, generating an output signal (or change in output signal) supplied to OR logic (e.g., OR gate) along with EM control A. In one example, the OR logic outputs a signal to pull the EM signal 358 high and disables emission by disabling the current flow to the display circuitry 330 from the drive circuitry. Accordingly, the LED pulse width is function of applied data voltage.

The reference voltage ($V_{ref}$) supplied to transistors 362, 364, and 366 controls the final current through the display elements. The switch 331 (Vneg switch) is utilized for selecting a row of display elements to be emitted based on inputs EM 305 or EM 307. The output signals from the select circuitry 304 share a pin (e.g., ramp generator pin) or pad at output node 321 in order to reduce a number of pins or communication channels.

Figure 5:
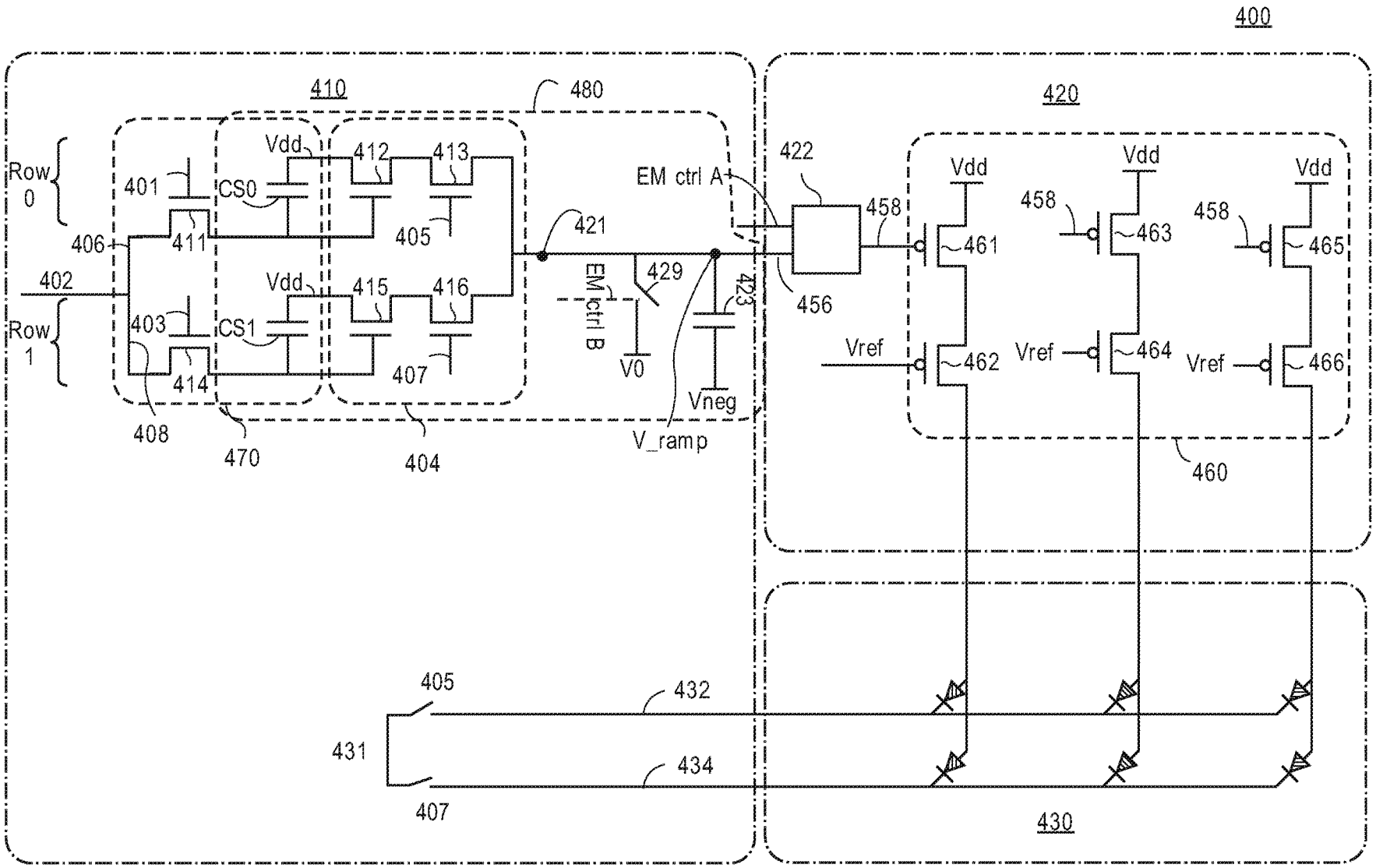
FIG. 5 is a block diagram of a hybrid micro-driver display architecture 400, according to one embodiment.

FIG. 5 is a block diagram of a hybrid micro-driver display architecture 400, according to one embodiment. In one embodiment, the hybrid μDriver display architecture 400 includes similar components and functionality as discussed in conjunction with display architecture 300 except that the ramp generator 480 has been moved to the backplane 410. The display architecture 400 includes the backplane 410 and a micro-driver 420. The backplane 400 includes sample and hold circuitry 470 and select circuitry 404 (e.g., select logic, multiplexer) for selecting input data signals 402 (e.g., data signals 406, 408) and generating output signals at output node 421 that have been multiplexed in a current domain with multiple rows (row 0, row 1) of the circuitry 470 and select circuitry 404 to generate the multiplexed output signals at output node 421. In one example, row 0 of sample and hold circuitry includes a data scan transistor 411 and a data storage capacitor CS 0 while row 0 of select circuitry includes a transistor 412 and a transistor 413. In a similar manner, row 1 of circuitry 470 includes a data scan transistor 414 and a data storage capacitor CS 1 while select circuitry 404 includes a transistor 415 and a transistor 416.

In one embodiment, the select circuitry 404 selects a data signal 406 from row 0 by enabling the scan transistor 411 with scan 401 signal to pass the data signal 406 to the data storage capacitor CS 0, which samples the data signal 406 and holds a value for the data signal 406. A voltage to current conversion occurs in which transistor 412 generates a current. A current flows through transistor 413 and becomes an output value of the select circuitry 404 if the transistors 412 and 413 are both enabled (e.g., enabled to have conductive channels). An emission signal EM 405 can be applied to the transistor if desired for enabling or disabling the transistor 413. Other rows can be selected at a different time if desired for selecting a data signal for a particular row. In this manner, the select circuitry 404 performs analog multiplexing in the current domain to select a data signal and generate an output signal with a single shared pin or pad.

The micro-driver (μDriver) integrated circuit (IC) 420 includes emission logic 422 (e.g., OR logic, comparator) and drive circuitry 460 (e.g., transistors 461-466). The backplane 410 includes a ramp signal generator 480 that includes a switch 429 that receives an emission control signal (e.g., EM control B signal), a ramp capacitor 423, and transistors (e.g., transistors of the select circuitry 404) for generating a current for the ramp signal generator. The ramp signal generator may also include data storage capacitors CS0 and CS1. The ramp signal generator 480 receives input from the circuitry 470, the transistors of the select circuitry 404 receive this input and generate output signals at output node 421, and the drive circuitry 460 couples to and drives current to display circuitry 430 having rows 432 and 442 of display elements, standard LED, organic LED, or another current driven light emitting devices. Each row of the display circuitry 430 corresponds to a row of the circuitry 470 and select circuitry 404. In one example, the display circuitry 430 includes 2 rows and 3 columns of LED devices. The emission logic 422 may include OR logic and/or a comparator. The emission logic 422 generates an EM signal 458 based on receiving a first input 456 from the ramp generator and a second input signal is an emission control signal EM control A.

The reference voltage ($V_{ref}$) supplied to transistors 462, 464, and 466 controls the final current through the display element. The switch 431 (e.g., Vneg switch) is utilized for selecting a row of display elements to be emitted based on inputs EM 405 or EM 407. The output signals at output node 421 from the select circuitry 404 share a pin (e.g., ramp generator pin) or pad in order to reduce a number of pins or communication channels.

Figure 6:
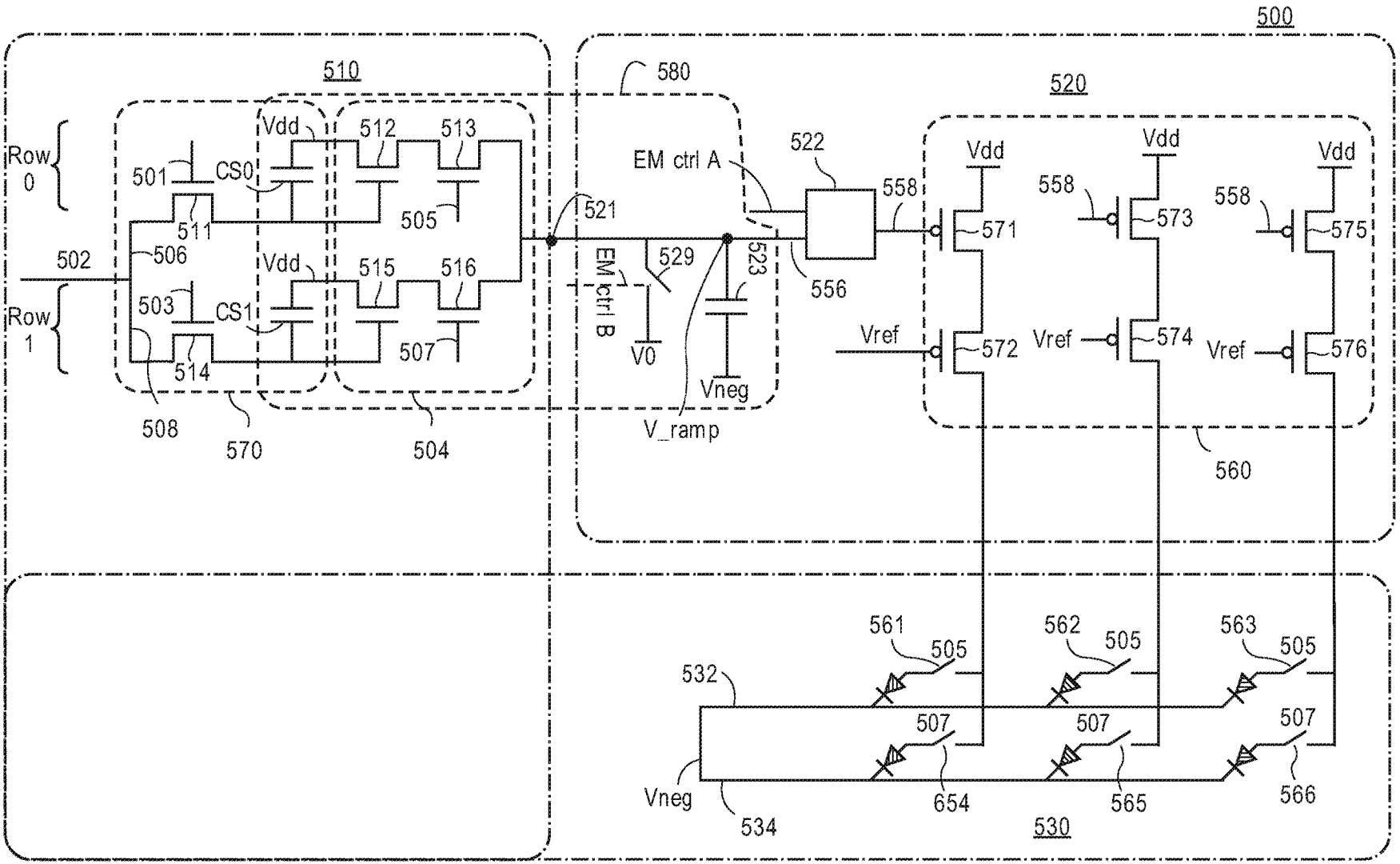
FIG. 6 is a block diagram of a hybrid micro-driver display architecture 500, according to one embodiment.

FIG. 6 is a block diagram of a hybrid micro-driver display architecture 500, according to one embodiment. In one embodiment, the hybrid μDriver display architecture 500 includes similar components and functionality as discussed in conjunction with display architectures 300 and 400 except that the LED devices each have a switches. The display architecture 500 includes the backplane 510 and a micro-driver 520. The backplane 510 includes sample and hold circuitry 570 and select circuitry 504 (e.g., select logic, multiplexer) for selecting input data signals 502 (e.g., data signals 506, 508) and generating output signals at output node 521 that have been multiplexed in a current domain with multiple rows (row 0, row 1) of the circuitry 570 and select circuitry 504 to generate the multiplexed output signals at output node 521. In one example, row 0 of sample and hold circuitry includes a data scan transistor 511 and a data storage capacitor CS 0 while row 0 of select circuitry includes a transistor 512 and a transistor 513. In a similar manner, row 1 of circuitry 570 includes a data scan transistor 514 and a data storage capacitor CS 1 while select circuitry 504 includes a transistor 515 and a transistor 516.

In one embodiment, the select circuitry 504 selects a data signal 506 from row 0 by enabling the scan transistor 511 with scan 501 signal to pass the data signal 506 to the data storage capacitor CS 0, which samples the data signal 506 and holds a value for the data signal 506. A voltage to current conversion occurs in which transistor 512 generates a current. A current flows through transistor 513 and becomes an output value of the select circuitry 504 if the transistors 512 and 513 are both enabled (e.g., enabled to have conductive channels). An emission signal EM 505 can be applied to the transistor if desired for enabling or disabling the transistor 513. Other rows can be selected at a different time if desired for selecting a data signal for a particular row. In this manner, the select circuitry 504 performs analog multiplexing in the current domain to select a data signal and generate an output signal at output node 521 with a single shared pin or pad.

The micro-driver (μDriver) integrated circuit (IC) 520 includes emission logic 522 (e.g., OR logic, comparator) and drive circuitry 560 (e.g, transistors 571-576). The backplane 510 includes a ramp signal generator 580 that includes a switch 529 that receives an emission control signal (e.g., EM control B signal), a ramp capacitor 523, and transistors (e.g., transistors of the select circuitry 504) for generating a current for the ramp signal generator. The ramp signal generator may also include data storage capacitors CS0 and CS1. The ramp signal generator 580 receives input from the circuitry 570, the transistors of the select circuitry 504 receive this input and generate output signals at output node 521, and the drive circuitry 560 couples to and drives current for display circuitry 530 having rows 532 and 542 of display elements, standard LED, organic LED, or another current driven light emitting devices. Each row of the display circuitry 530 corresponds to a row of the circuitry 570 and select circuitry 504. In one example, the display circuitry 530 includes 2 rows and 3 columns of LED devices. The emission logic 522 may include OR logic and/or a comparator. The emission logic 522 generates an output signal 558 based on receiving a first input 556 from the ramp generator and a second input signal is an emission control signal EM control A.

The reference voltage ($V_{ref}$) supplied to transistors 572, 574, and 576 controls the final current through the LED. The switches 561-566 are individually utilized for selecting individual display elements or rows 532 and 534 of LEDs to be emitted based on inputs EM 505 or EM 507. The output signals from the select circuitry 504 share a pin (e.g., ramp generator pin) or pad at output node 521 in order to reduce a number of pins or communication channels.

Figure 7A:
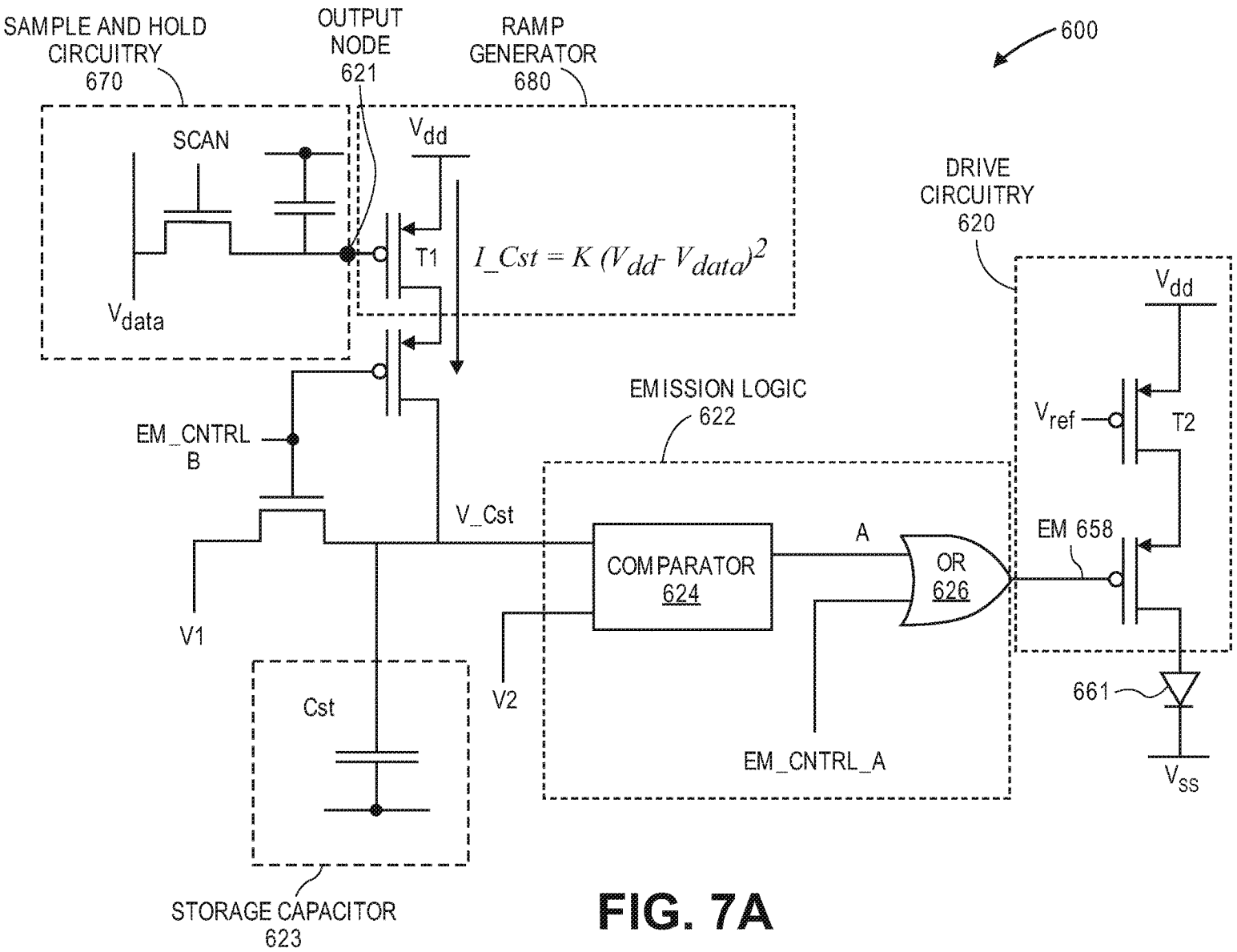
FIG. 7A is a block diagram of a hybrid-analog PWM LED Driving Circuit display architecture 600, according to an embodiment.

FIG. 7A is a block diagram of a hybrid-analog PWM Driving Circuit display architecture 600, according to an embodiment. The architecture 600 is illustrated as driving a single display element, LED, or sub-pixel element. However, multiple circuits may be used to drive multiple sub-pixels for a display. The architecture 600 includes backplane components that provide input to components within a μDriver IC. In one embodiment, the architecture includes backplane components including an exemplary sample and hold circuitry 670 having a SCAN (e.g., $V_{select}$) and $V_{data}$ inputs and an additional backplane storage capacitor Cst 623.

In one embodiment the μDriver IC component includes emission logic 622, drive circuitry 620, and ramp signal generator 680. The emission logic 622 includes a comparator 624 and an OR gate 626. The ramp signal generator 680 receives input from the sample and hold circuit 670 of the backplane, while the drive circuitry 620 couples to and drives current for a display circuitry 661 (e.g., LED 661), which in one embodiment is a single μLED, but may also be configured to drive one or more standard LED, organic LED, or another current driven light emitting devices. The OR gate 626 has a first input A from the comparator 624 and a second input from an EM_CNTRL_A input. In one example, the LED array includes rows and columns of LED devices to be time multiplexed per column or row as discussed in a similar manner in FIGS. 2-6.

An exemplary drive cycle for the PWM LED driving circuitry 620 is as follows. Upon assertion of the SCAN input to the sample and hold circuit 670, an input voltage $V_{data}$ is applied to the T1 gate in the ramp generator 680. In one example, rows of sample and hold circuitry can receive input data signals and select circuitry selects a data signal to be time multiplexed at output node 621 as discussed in a similar manner in FIG. 1-5. A voltage to current conversion occurs in which transistor T1 of the ramp signal generator 680 generates a current I_Cst, which is a square function of applied $V_{data}$. Where K is the dielectric constant of T1, the current I_Cst is computed as:

$$I_{Cst}=K(V_{dd}-V_{data})^2$$

Accordingly, as with a traditional (e.g., OLED) display, gamma can be achieved via a voltage to current conversion. The EM_CNTRL_A signal coupled to the OR gate 626 is asserted (e.g., triggers high) to ensure that EM 658 is not enabled, keeping the LED 661 from emitting. The EM_CNTRL B signal also triggers high to discharge Cst 623 and to isolate Cst 623 from T1. Ramp generation at the ramp signal generator 680 begins when EM_CNTRL B is de-asserted and I_Cst charges Cst 623. Charging Cst 623 generates a ramp voltage V_Cst, the slope of which is a function of the applied data voltage ($V_{data}$).

In one embodiment, actual emission of the LED 661 is moderated by EM_CNTRL_A, and emission does not begin until de-assertion of the EM_CNTRL_A signal triggers emission enable. The sub-pixel circuits can be configured such that all sub-pixels in a row start emission at the same time. At emission enable, the LED 661 will begin to emit based on current supplied by T2 of the drive circuitry 620, which is determined in part by the voltage ($V_{ref}$) supplied to T2.

At the comparator 624, the ramp voltage V_Cst and a reference voltage V2 are compared. V2 is the reference voltage to which V_Cst is compared, and defines the threshold in which the comparator will trip. When the ramp voltage V_Cst becomes equal to V2, the comparator trips, generating output signal A to the OR gate 626, which pulls the EM signal 658 high and disables emission by disabling the current flow to the LED 661 from T2. Accordingly, the LED pulse width is function of applied data voltage ($V_{data}$).

The LED reference voltage ($V_{ref}$) supplied to T2 controls the final current through the LED. Each of V2 and ($V_{ref}$) can be adjusted for dimming control. The EM_CNTRL_A signal maintains EM high to disable emission completely for black level. Accordingly, EM_CNTRL_A may be enabled before EM_CNTRL B and remain high until after comparator (e.g., input A to the OR gate 626) becomes high if the subpixel is intended to emit a completely black level.

Figure 7B:
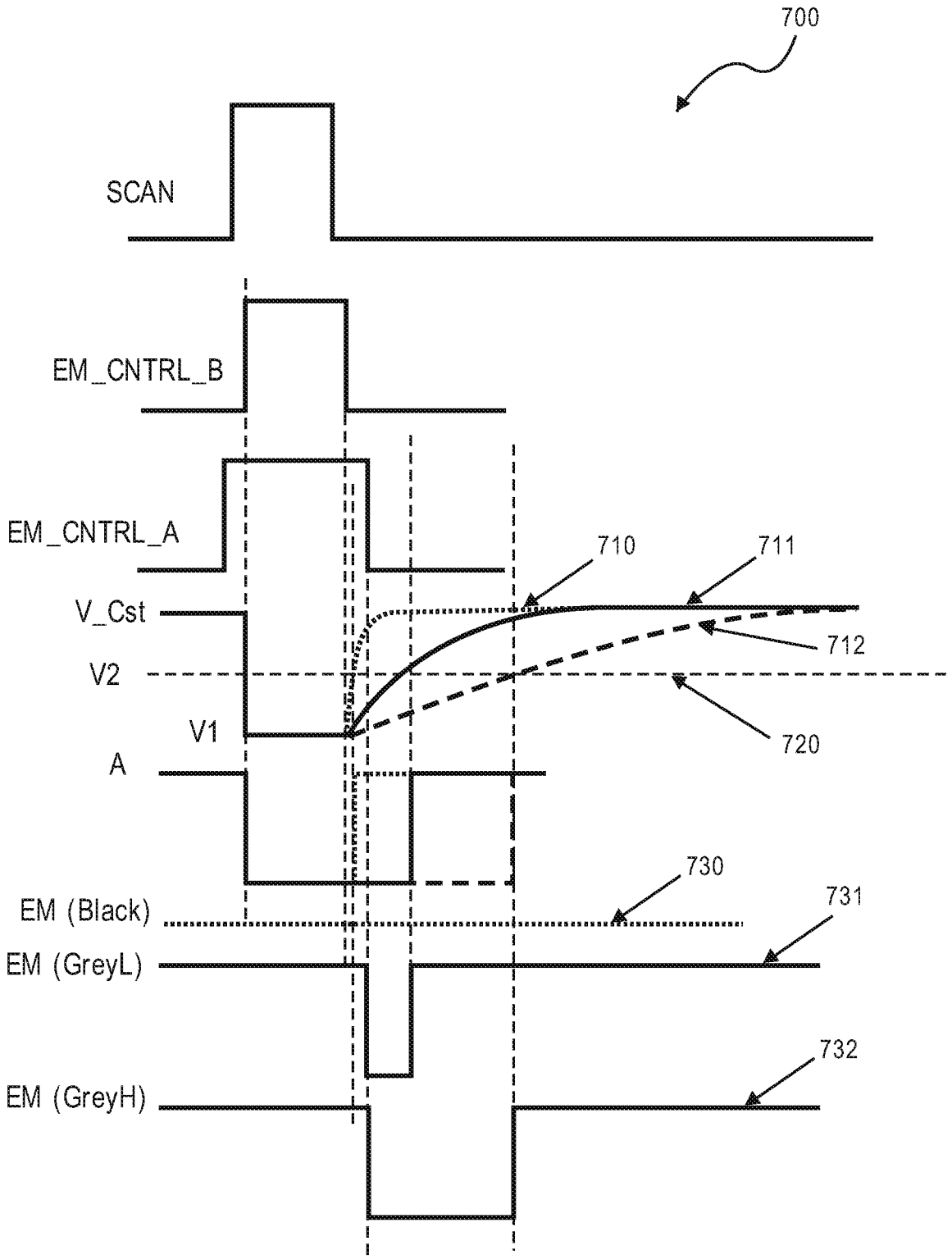
FIG. 7B shows an exemplary timing diagram 700 for the PWM LED driving circuitry 620 of FIG. 7A.

FIG. 7B shows an exemplary timing diagram 700 for the PWM drive circuitry 620 of FIG. 7A. As illustrated, asserting a SCAN input (e.g., $V_{select}$) and EM_CNTRL B input prepares the PWM driving circuitry 620 for emission, while the EM_CNTRL_A, V1, and V2 can shape the length of the pulse. Charging the storage capacitor Cst 623 shown in FIG. 7A causes the V_Cst voltage ramp. Starting from input voltage V1, the V_Cst voltage ramp can vary between a short ramp 710, a medium ramp 711, and a long ramp 712, and has a slope based on the input data voltage (e.g., $V_{data}$). Once the V_Cst voltage exceeds the V2 voltage 720 the comparator triggers high, causing internal signal A to trigger, ending the emission pulse. If EM_CNTRL_A is asserted until after input A is triggered, no emission pulse will occur (e.g., EM(Black) 730). Otherwise, emission pulses of varying lengths, from a low gray level pulse (e.g., EM (GrayL) 731 based on a medium ramp 711 to a high gray level pulse (e.g., EM (GrayH)) 732 based on a long ramp 712. Varying V2 and V1 can adjust the length of the emission pulse as needed.

Figure 8:
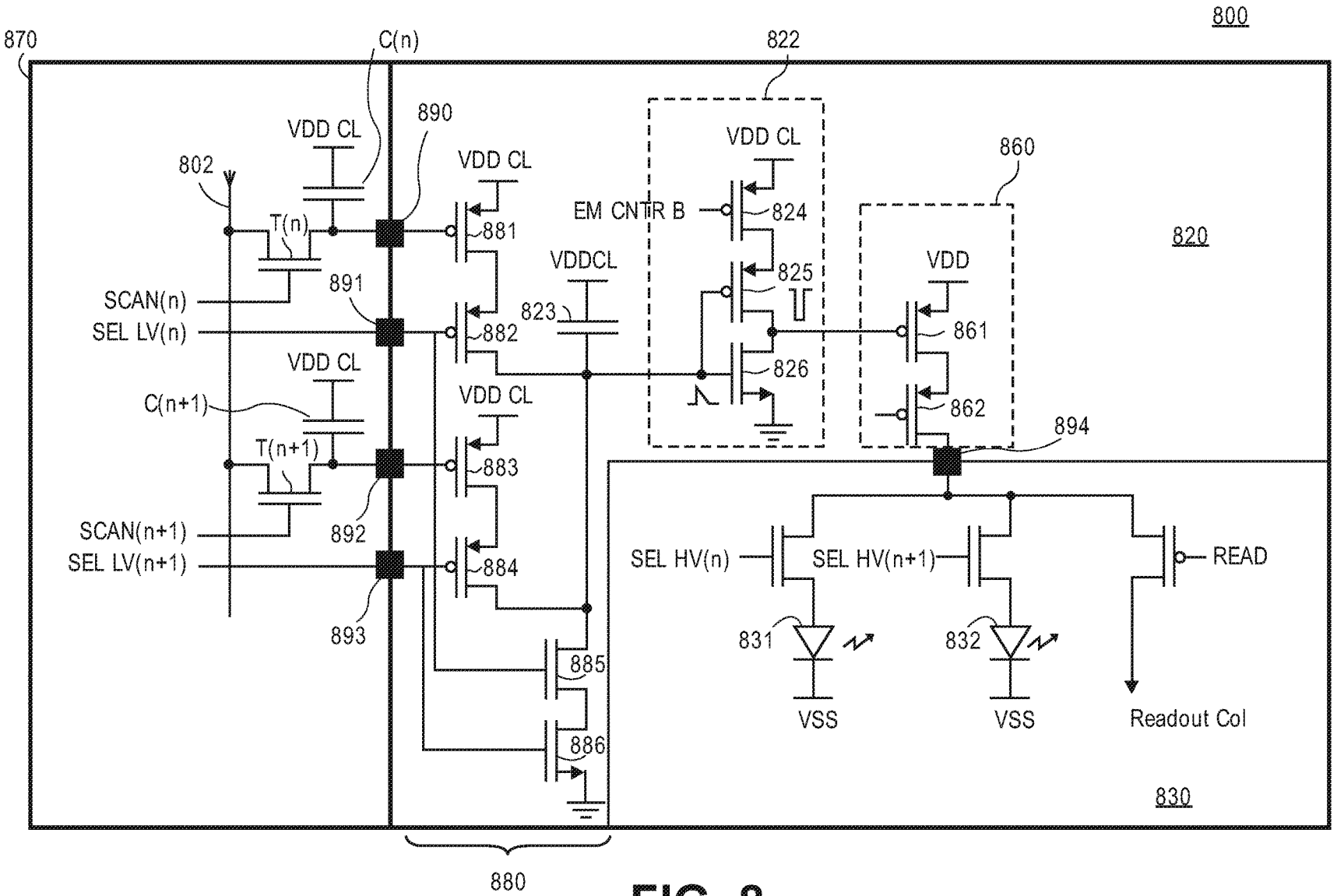
FIG. 8 is a block diagram of a hybrid-analog PWM LED Driving Circuit display architecture 800, according to an embodiment.

FIG. 8 is a block diagram of a hybrid-analog PWM Driving Circuit display architecture 800, according to an embodiment. The architecture 800 is illustrated as driving two LED devices or sub-pixel elements. However, multiple circuits may be used to drive multiple sub-pixels for a display. The architecture 800 includes backplane components that provide input to components within a μDriver IC. In one embodiment, the architecture includes backplane components including an exemplary sample and hold circuitry 870 (e.g., implemented in oxide) having data inputs 802, scan (n) input for transistor T(n), scan (n+1) input for transistor (n+1), select LV(n) input, select LV(n+1) input, data storage capacitor C(n), data storage capacitor C(n+1), and backplane display circuitry 830 (e.g., LTPS). The circuitry 870 includes output node(s) 890-893. In one example, output nodes 890 and 892 each include 6 nodes (e.g., 6 pins) while output nodes 891 and 893 are each single nodes (e.g., 1 pin) to be shared for time multiplexing of different select signals as discussed in conjunction with the description of FIGS. 1-5.

In one embodiment the μDriver IC component includes emission logic 822, drive circuitry 860, and ramp signal generator 880. The emission logic 822 includes transistors 824-826. The ramp signal generator 880 includes transistors 881-886 and receives input from the sample and hold circuit 870 on the backplane, while the drive circuitry 860 couples to and drives current for the display circuitry 830 that may also be configured to drive one or more standard LED, organic LED, or another current driven light emitting devices. In one example, the display circuitry 830 includes rows and columns of LED devices (e.g., LEDs 831, 832, etc.) that are coupled to nodes 894 (e.g., 6 nodes, 6 pins) via select transistors (e.g., select HV(n), select HV(n+1)). A read transistor is also coupled to the output nodes 894 and forms part of a read column.

An exemplary drive cycle for the PWM drive circuitry 860 is as follows. Upon assertion of the SCAN input to the sample and hold circuit 870, an input voltage $V_{data}$, data signals 802, is applied to the gate in the transistors 881 or 883 in the ramp signal generator 880. In one example, rows of sample and hold circuitry can receive input data signals 802 and select LV(n) input, select LV(n+1) input selects a data signal 802 (e.g., data n signal, data n+1 signal, etc.) to be time multiplexed at output nodes (e.g., output nodes 891, output nodes 893) as discussed in a similar manner in FIGS. 2-6. A voltage to current conversion occurs in which transistor 881 or 883 of the ramp signal generator 880 generates a current and transistors 882 or 884 if enabled drive a current of the ramp generator.

In one embodiment, upon emission enable of the emission logic 822, the display circuitry 830 will begin to emit based on current supplied by the transistors 861 and 862 of the drive circuitry 860, which is determined in part by the voltage ($V_{ref}$) supplied to transistor 862.

In one example, the architecture 800 includes 6 data (n) signals, 6 data (n+1) signals, a select LV(n) input, a select LV (n+1) input, a reference voltage node, an emission control signal B, 6 pixel nodes, a node for VDD, a node for VCC_CL, and a node for a ground voltage for a total of 25 pads. In this example, the micro-driver 820 has and lateral dimensions that is based on a pitch or spacing (lateral dimension) of pixels of display circuitry 830. The display circuitry 830 may be a semiconductor-based material having a maximum lateral dimension of 1 to 300 μm, 1 to 100 μm, 1 to 20 μm, or more specifically 1 to 10 μm, such as 5 μm.

Figure 9:
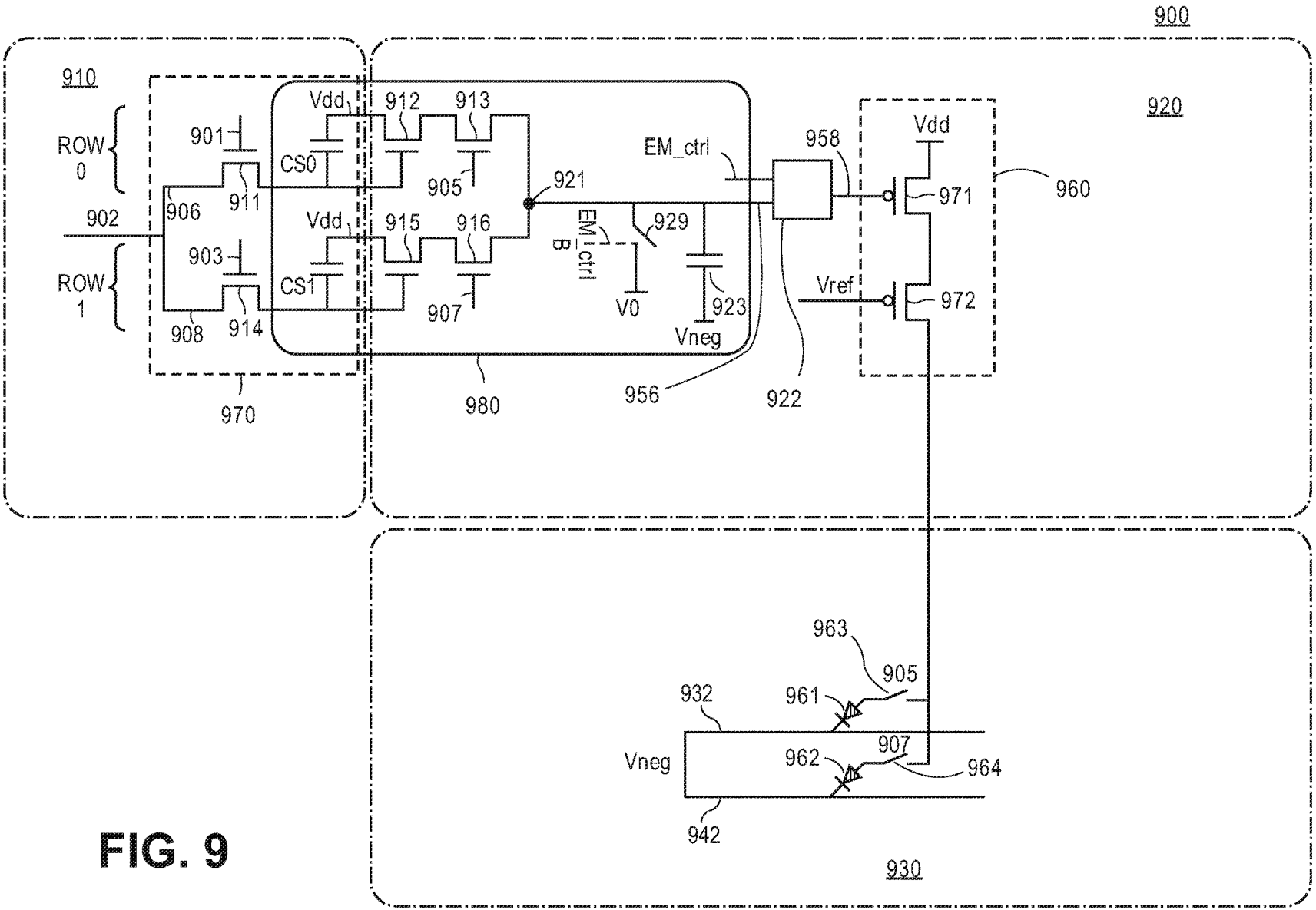
FIG. 9 is a block diagram of a hybrid micro-driver display architecture 900, according to one embodiment.

FIG. 9 is a block diagram of a hybrid micro-driver display architecture 900, according to one embodiment. In one embodiment, the hybrid μDriver display architecture 900 includes similar components and functionality as discussed in conjunction with display architectures 200, 300, 400, and 500 except that the display element devices each have switches. The display architecture 900 includes the backplane 910 and a micro-driver 920. The backplane 910 includes sample and hold circuitry 970 for sampling and holding input data signals 902 (e.g., data signals 906, 908) with transistors 911 and 914 and data storage capacitors CS0 and CS1. Transistors 912 and 915 along with select transistors 913 and 916 generate output signals at output node 921 that have been multiplexed in a current domain with multiple rows (row 0, row 1) of the circuitry 570 to generate the multiplexed output signals at output node 921.

In one embodiment, the control signal EM 905 selects a data signal 906 from row 0 when the scan transistor 911 is enabled with scan 901 signal to pass the data signal 906 to the data storage capacitor CS 0, which samples the data signal 906 and holds a value for the data signal 906. A voltage to current conversion occurs in which transistor 912 generates a current. A current flows through transistor 913 and becomes an output value at output node 921 if the transistors 912 and 913 are both enabled (e.g., enabled to have conductive channels). An emission signal EM 905 can be applied to the transistor if desired for enabling or disabling the transistor 913. Other rows can be selected at a different time if desired for selecting a data signal for a particular row. In this manner, the control signals EM 905 or EM 907 perform analog multiplexing in the current domain to select a data signal and generate an output signal at output node 921 with a single shared pin or pad.

The micro-driver (μDriver) integrated circuit (IC) 920 includes emission logic 922 (e.g., OR logic, comparator) and drive circuitry 960 (e.g., transistors 971-972). A ramp signal generator 980 includes the capacitors CS 0, CS 1, transistors 912-915, a switch 929 that receives an emission control signal (e.g., EM control B signal) for resetting a ramp capacitor 923. The ramp signal generator 980 receives input from the circuitry 970, the transistors 912-916 receive this input and generate output signals at output node 921, and the drive circuitry 960 couples to and drives current for the display circuitry 930 having rows 932 and 942 of display elements, standard LED, organic LED, or another current driven light emitting devices. Each row of the display circuitry 930 corresponds to a row of the circuitry 970. In one example, the micro-LED array 930 includes 2 rows and 1 column of LED devices (e.g., devices 961 and 962). The emission logic 922 may include OR logic and/or a comparator. The emission logic 922 generates an output signal 958 based on receiving a first input 956 from the ramp generator and a second input signal is an emission control signal EM control A.

The LED reference voltage ($V_{ref}$) supplied to transistors 972 controls the final current through the LEDs. The switches 963 and 964 are individually utilized for selecting individual LEDs or rows 932 and 934 of LEDs to be emitted based on inputs EM 905 or EM 907. The output signals share a pin (e.g., ramp generator pin) or pad at output node 921 in order to reduce a number of pins or pads. The ramp generator 980 requires 3 control signals (e.g., EM 905, EM 907, EM control B) for each micro-driver 920 to select one current source using transistors 913 or 916 and also for resetting Cramp 923.

Figure 10:
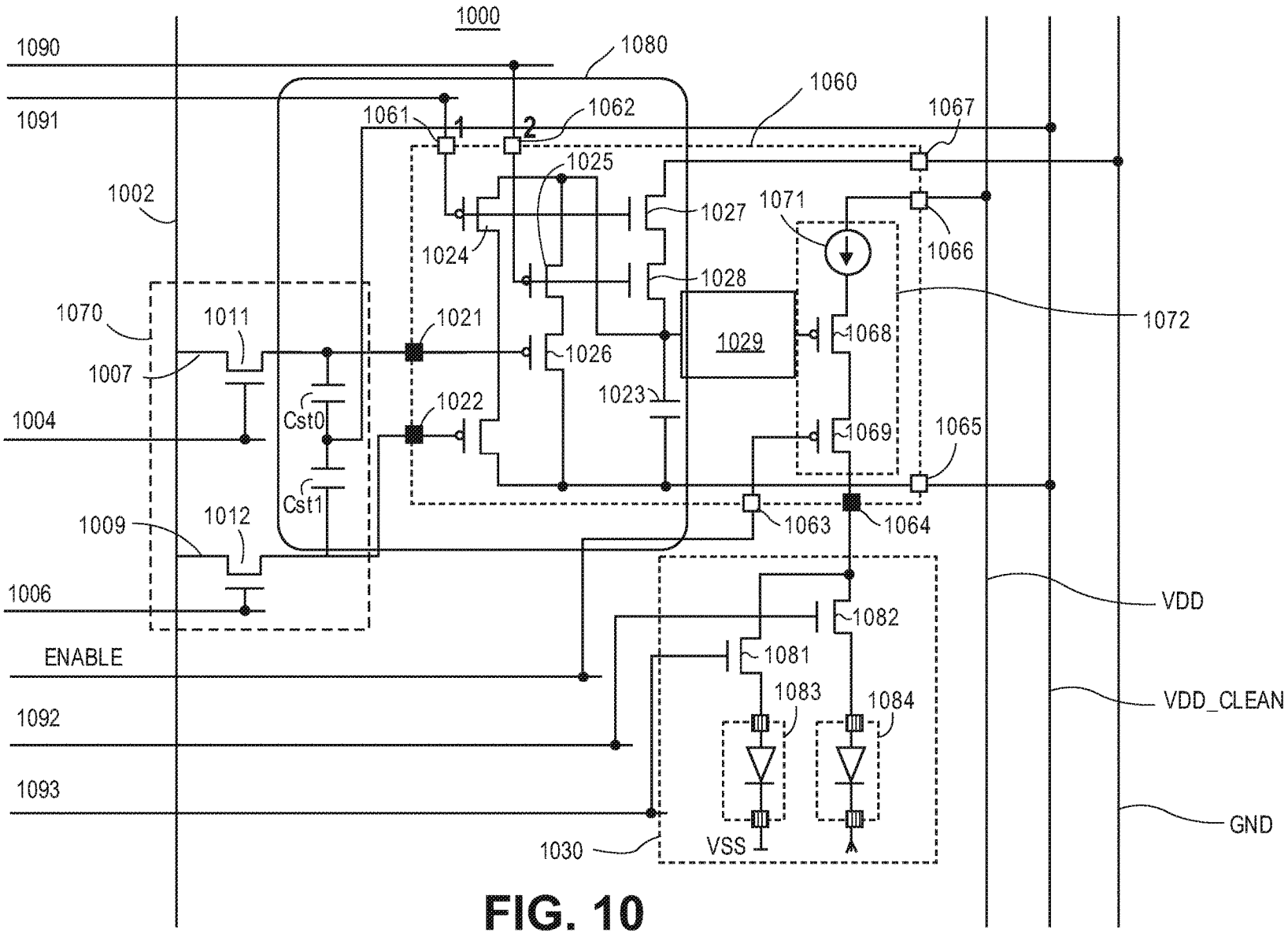
FIG. 10 is a block diagram of a hybrid micro-driver display architecture 1000, according to one embodiment.

FIG. 10 is a block diagram of a hybrid micro-driver display architecture 1000, according to one embodiment. In one embodiment, the hybrid μDriver display architecture 1000 includes similar components and functionality as discussed in conjunction with display architectures 900 except that the ramp generator has fewer control signals. In one example, the ramp generator 1080 has only 2 control signals select 1090 and select 1091 in contrast to the 3 control signals of the ramp generator 980. The display architecture 1000 includes sample and hold circuitry 1070 for sampling and holding input data signals 1002 (e.g., data signals 1006, 1008) with transistors 1011 and 1014, data storage capacitors CST0 and CST1, and scan signals 1004 and 1006.

The ramp generator 1080 includes capacitors CST0, CST1, transistors 1024-1028, and capacitor Cramp 1023. In one example, a micro-driver 1060 includes the transistors 1024-1028, capacitor Cramp 1023, comparator 1029, and driving circuitry 1072. The driving circuitry 1072 includes a current source 1071, and transistors 1068 and 1069. The micro-driver 1060 includes nodes 1021 and 1022 that may include multiple nodes or pads and may have been multiplexed in a current domain to generate the output signals at nodes 1021 and 1022. The output nodes 1064 may also include multiple nodes or pads and may have been multiplexed. The micro-driver 1060 also includes nodes 1061, 1062, 1067, 1066, 1065, and 1063. A display circuitry 1030 includes transistors 1091 and 1092 that receive select signals 1092 and 1093, respectively. The display circuitry 1030 also includes micro LED devices 1083 and 1084.

In one example, a reset voltage (e.g., GND (e.g., 0 volts)) for Crmp 1023 and a reference voltage (e.g., VDD_CLEAN (e.g., 6 volts)) for Cst 0, Cst 1 are separated from VSS and VDD (e.g., 6 volts) because the reset voltage and the reference voltage are not stable based on their resistance and the current supply for micro LEDs of other pixels.

Figure 11:
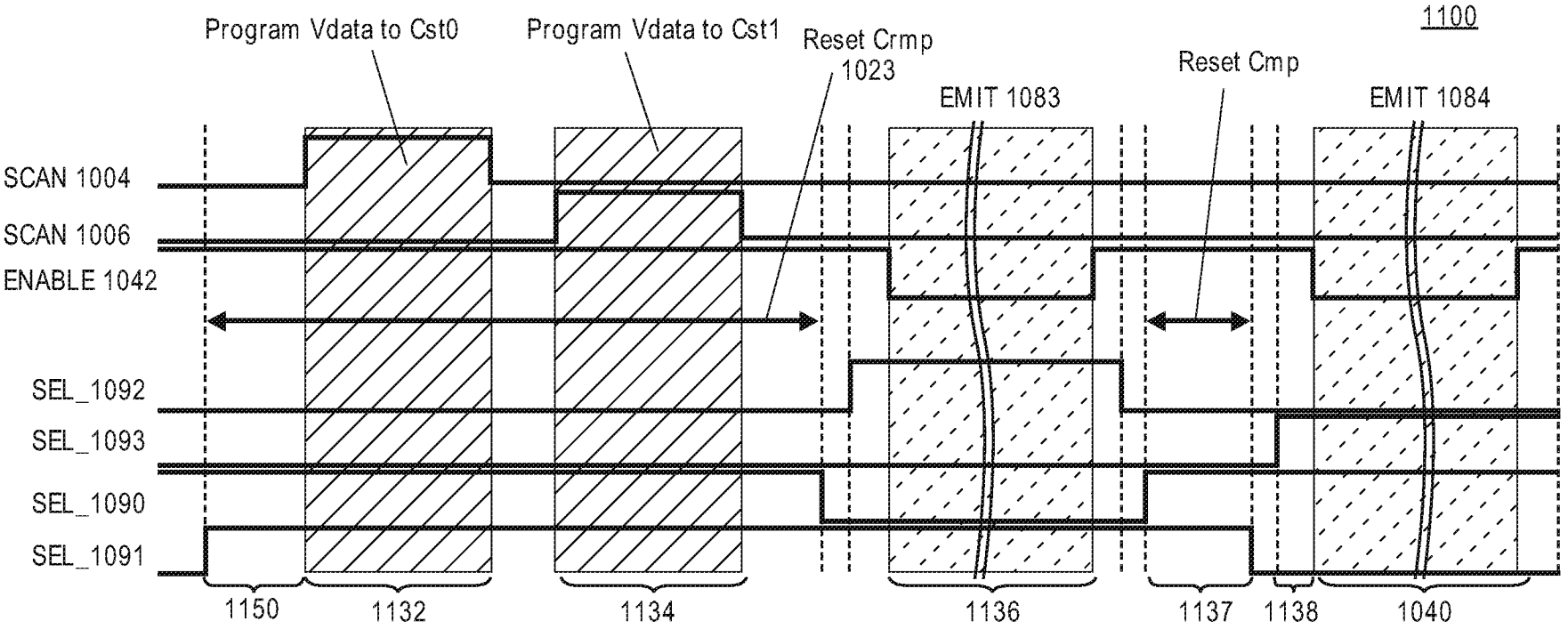
FIG. 11 shows an exemplary timing diagram 1100 for the micro-driver 1060 of FIG. 10 in accordance with one embodiment.

FIG. 11 shows an exemplary timing diagram 1100 for the micro-driver 1060 of FIG. 10. As illustrated, asserting a scan input signal 1004 at time period 1132 programs data 0 of data 1002 to CST0 and asserting a scan input signal 1006 at time period 1134 programs data 1 of data 1002 to CST1. The enable signal 1042 is asserted as indicated in FIG. 11 to reset the capacitor Cramp 1023. The select signals 1090-1093 are asserted or not asserted as indicated in FIG. 11 during the programming of data signals. Next, for an emission of micro LED 1084 at time period 1136, the select signals 1091 and 1092 are asserted while other signals illustrated in FIG. 11 are not asserted which causes transistors 1011, 1012, 1024, 1028, and 1081 to be disabled and a current path to be generated through transistors 1026 and 1025 to a charging node 1051. This storage capacitor Cramp 1023 shown in FIG. 11 is charged causing a voltage ramp. The voltage ramp can vary between a short ramp, a medium ramp, and a long ramp, and has a slope based on the input data voltage (e.g., $V_{data}$) of data signals 1002. In one example, once the voltage at the charging node 1051 exceeds a reference voltage the comparator 1029 triggers thus ending the emission pulse that was being driven by the driving circuitry 1072.

The enable signal 1042 can then be asserted at time period 1138 which resets the capacitor Cramp while transistors 1011, 1012, 1024, 1025, 1069, and 1081 are disabled. Next, for an emission of micro LED 1083 at time period 1140, the select signals 1090 and 1093 are asserted while other signals illustrated in FIG. 11 are not asserted during this time period. During a time period 1139, the voltage ramp begins based on an input data voltage of a data 1 signal having voltage stored at CST 1. The transistors 1011, 1012, 1025, 1028, 1069, and 1082 are disabled during this time period 1139 and a current path is generated through transistors 1022 and 1024 to a charging node 1051. This storage capacitor Cramp 1023 shown in FIG. 11 is charged causing a voltage ramp. The voltage ramp can vary between a short ramp, a medium ramp, and a long ramp, and has a slope based on the input data voltage (e.g., $V_{data}$) of data signals 1002. In one example, once the voltage at the charging node 1051 exceeds a reference voltage the comparator 1029 triggers thus ending the emission pulse that was being driven by the driving circuitry 1072. During the time period 1140, the transistor 1081 is enabled thus allowing a current path through the transistors 1068, 1069, and 1081 into the LED 1083. During a time period 1150, the ramp generation stops upon asserting the enabling signal and the select 1090 signal.

A chip size of a micro-driver can be reduced with time multiplexing of shared pins or pads as discussed herein. Another improvement for a micro-driver would be yield in mounting micro-drivers to a display panel. This yield can be increased by providing redundant micro-drivers which can be utilized if a main or primary micro-driver is not functionally operable. However, a laser cutting process is needed even if a mounting process yield is 100% for mounting micro-drivers on a substrate of a display panel for when columns of pixels are routed to primary and redundant micro-drivers and also when a spacing or pitch between unit cells of a backplane is twice of a spacing or pitch between micro-drivers. For example, if red sub-pixels are routed to the same communication line for both the primary and redundant micro-drivers, then laser cutting will be needed for disconnecting red sub-pixels from one of the micro-drivers for this communication line.

Figure 12:
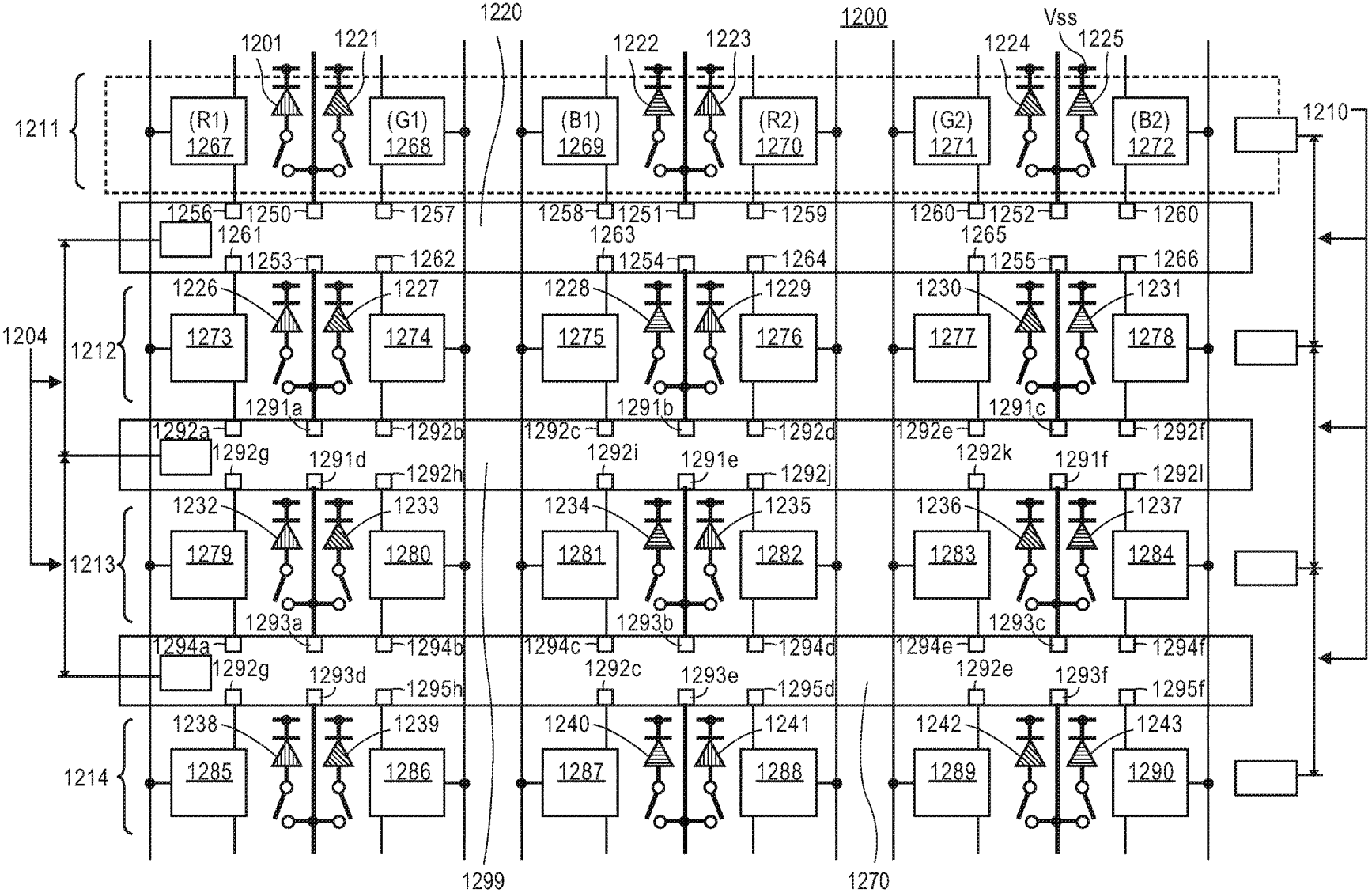
FIG. 12 illustrates a layout of a display panel having primary and redundant micro-drivers in which time multiplexing is utilized for reducing a layout area in accordance with one embodiment.

FIG. 12 illustrates a layout of a display panel having primary and redundant micro-drivers in which time multiplexing is utilized for reducing a layout area in accordance with one embodiment. A display panel 1200 includes display elements 1201, 1221-1225 arranged in a display element row 1211 of the display panel, display elements 1226-1231 arranged in a display element row 1212, display elements 1232-1237 arranged in a display element row 1213, and display elements 1238-1243 arranged in a display element row 1214. A main or primary micro-driver 1220 is arranged in a row of micro-drivers adjacent and coupled to the display element row 1211. The primary micro-driver includes output nodes 1250-1255 for driving emissions of the display element rows 1211 and 1212. The primary micro-driver also includes nodes 1256-1266 for coupling to logic. In one example, the selection logic 1267-1278 selects a first subset of display elements during a first time period and a second subset of display elements during a second time period. In this manner, the output nodes are shared for time multiplexing of display elements to be emitted. In this example, the selection logic 1267 selects a display element 1201 to be emitted during a first time period while the selection logic 1268 selects a display element 1221 to be emitted during a second time period. The display elements 1201 and 1221 share the output node 1250 of the micro-driver 1220.

A redundant micro-driver 1299 is arranged in a row of redundant micro-drivers adjacent and coupled to the display element rows 1212 and 1213. The redundant micro-driver 1299 includes output nodes 1291*a-f* for driving emissions of the display element rows 1212 and 1213 if the redundant driver is being used. The redundant micro-driver also includes nodes 1292*a*-1 for coupling to logic including selection logic 1273-1284.

A primary micro-driver 1270 is arranged in a row of primary micro-drivers adjacent and coupled to the display element rows 1213 and 1214. The micro-driver 1270 includes output nodes 1293*a-f* for driving emissions of the display element rows 1213 and 1214. The micro-driver also includes nodes 1294*a-f* and 1295 *a-f* for coupling to logic including selection logic 1279-1290.

For the display panel 1200, a pitch (e.g, 50-70 microns) between unit cells of a backplane has been reduced to approximately match a pitch (e.g., 50-60 microns) between micro-drivers. The reduced backplane pitch and time multiplexing leads to a reduced area of layout for the display panel 1200. The micro-drivers may each be surface mounted micro-driver chips.

Figure 13:
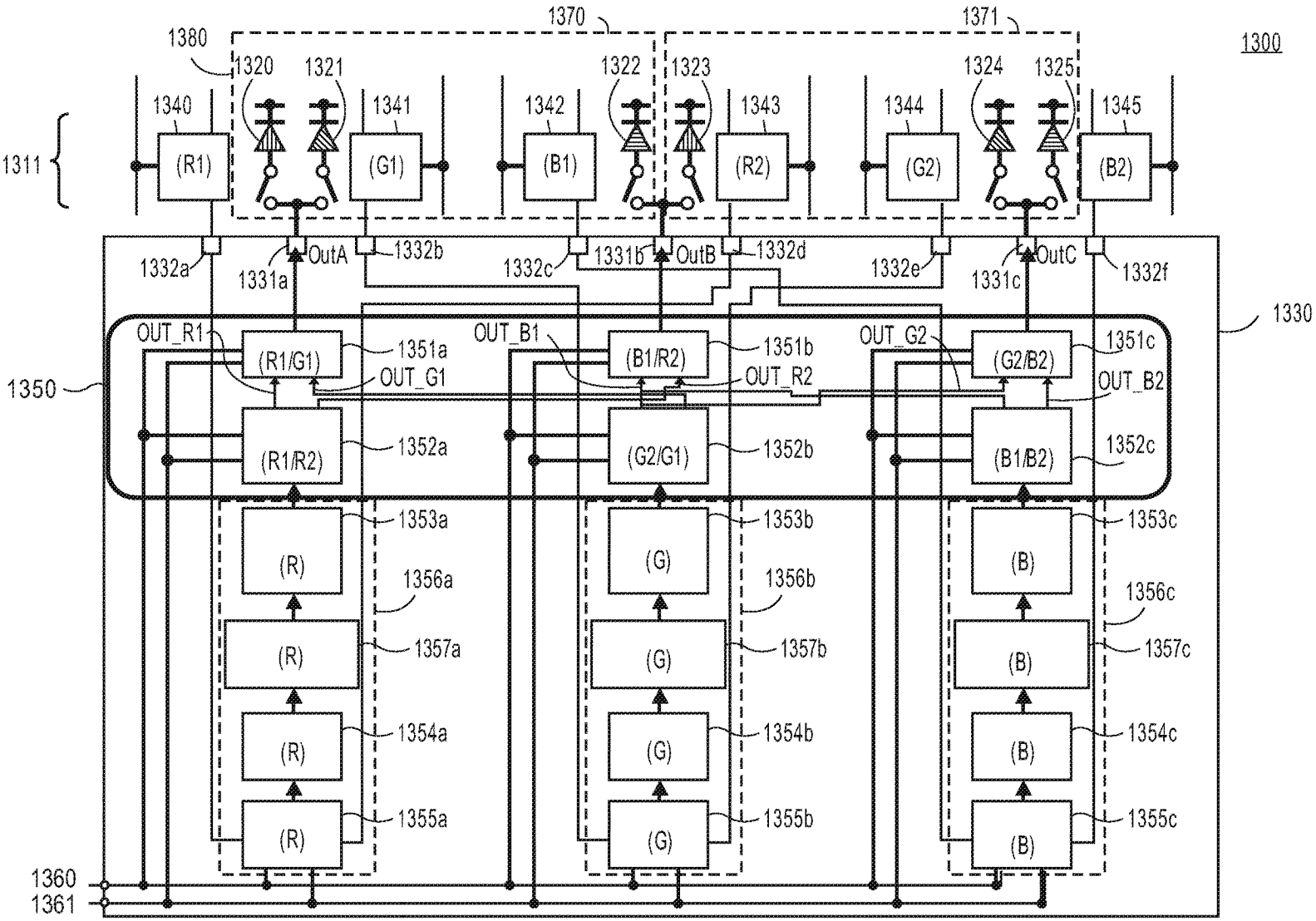
FIG. 13 illustrates a block diagram of a micro-driver of a display panel in accordance with one embodiment.

FIG. 13 illustrates a block diagram of a micro-driver of a display panel in accordance with one embodiment. A display panel 1300 includes display elements 1320-1325 arranged in a display element row 1311 of the display panel. A micro-driver 1330 is arranged in a row of micro-drivers adjacent and coupled to the display element row 1311. The micro-driver includes output nodes 1331*a-c* for driving emissions of the display element row 1311. The primary micro-driver may also include nodes 1332*a-f* for coupling to logic. In one example, the selection logic 1340-1345 selects a first subset of display elements during a first time period and a second subset of display elements during a second time period. In this manner, the output nodes are shared for time multiplexing of display elements to be emitted. In this example, the selection logic 1340 selects a display element 1320 to be emitted during a first time period while the selection logic 1341 selects a display element 1321 to be emitted during a second time period. The display elements 1320 and 1321 share the output node 1331*a* of the micro-driver 1330.

The micro-driver 1330 includes different driving logic 1356*a-c* having selectors 1355*a-c*, ramp generators 1354*a-c*, comparators 1357*a-c*, and current sources 1353*a-c* for driving different colors of the array of display elements or pixels. The select unit 1350 includes selectors 1351*a-c* and output splitters 1352*a-c* coupling the driving logic 1356*a-c* with an appropriate color of a display element. Each color of a display element may have a different emission characteristic, current source, PWM signal, etc.

In one embodiment, a selector 1351*a* and output splitter 1352*a* are coupled to the logic 1356*a* and receive select signals 1360 and 1361. The output splitter 1352*a* receives output signals (e.g., OUT_R1, OUT_R2) from a current source 1353*a* of the driving logic and sends an output OUT_R1 signal to the selector 1351*a* or sends an output OUT_R2 signal to the selector 1351*b*. The selector 1351*a* selects the OUT_R1 signal for driving a first color (e.g., red display element 1320) of a group of display elements 1380 or selects the OUT_G1 signal for driving a second color (e.g., green display element 1321) of the group of display elements 1380 of row 1311. A selector 1351*b* and output splitter 1352*b* are coupled to the logic 1356*b*. The output splitter 1352*b* receives output signals (e.g., OUT_G1, OUT_G2) from a current source 1353*b* of the driving logic 1356*b* and sends an output OUT_G1 signal to the selector 1351*a* or sends an output OUT_G2 signal to the selector 1351*c*. The selector 1351*b* selects the OUT_B1 signal for driving a third color (e.g., blue display element 1322) of the group of display elements 1380 or selects the OUT_R2 signal for driving a first color (e.g., red display element 1324) of the group of display elements 1371.

A selector 1351*c* and output splitter 1352*c* are coupled to the logic 1356*c*. The output splitter 1352*c* receives output signals (e.g., OUT_B1, OUT_B2) from a current source 1353*c* of the driving logic 1356*c* and sends an output OUT_B1 signal to the selector 1351*b* or sends an output OUT_B2 signal to the selector 1351*c*. The selector 1351*c* selects the OUT_G2 signal for driving a second color (e.g., green display element) of the group of display elements 1371 or selects the OUT_B2 signal for driving a third color (e.g., blue display element) of the group of display elements 1371. The group of display elements may each form a pixel and each display element may form a subpixel.

Figure 14:
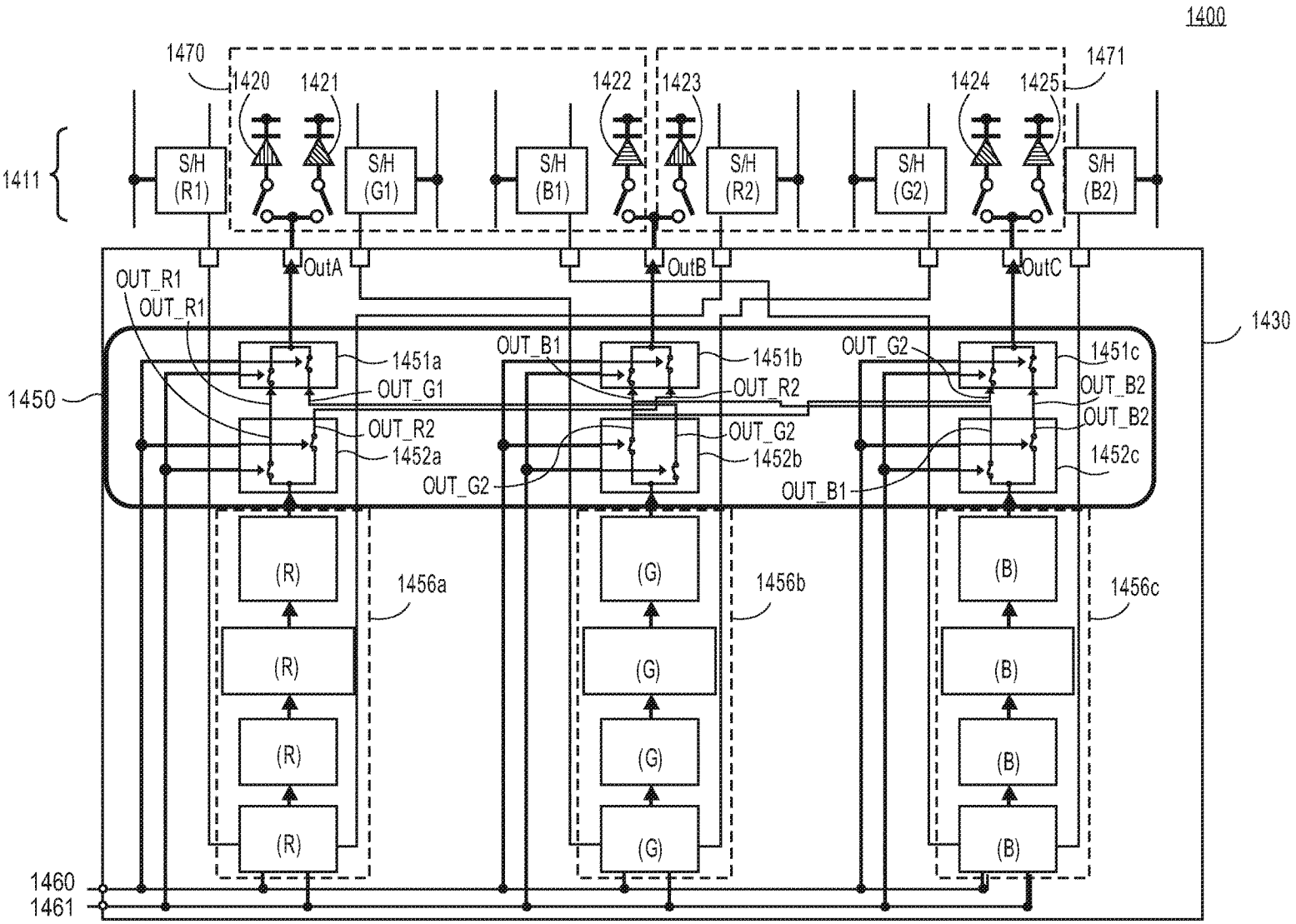
FIG. 14 illustrates a block diagram of a micro-driver of a display panel in accordance with one embodiment.

FIG. 14 illustrates a block diagram of a micro-driver of a display panel in accordance with one embodiment. A display panel 1400 includes similar components and functionality in comparison to the display panel 1300 of FIG. 13. In FIG. 14, the select unit 1450 is similar to the select unit 1350. The display panel 1400 includes display elements 1420-1425 arranged in a display element row 1411 of the display panel. A micro-driver 1430 is arranged in a row of micro-drivers adjacent and coupled to the display element row 1411. The micro-driver includes output nodes (outA-C) for driving emissions of the display element row 1411.

The micro-driver 1430 includes different logic 1456*a-c* (e.g., 1456*a-c* may include similar logic and components as logic 1356*a-c*) for driving different colors of the array of display elements or pixels. The select unit 1450 includes selectors 1451*a-c* and output splitters 1452*a-c* coupling the logic 1456*a-c* with an appropriate color of a display element. Each color of a display element may have a different emission characteristic, current source, PWM signal, etc.

In one embodiment, a selector 1451*a* and output splitter 1452*a* are coupled to the logic 1456*a* and receive select signals 1460 and 1461. The output splitter 1452*a* receives output signals (e.g., OUT_R1, OUT_R2) from a current source of the driving logic 1456*a* and sends an output OUT_R1 signal to the selector 1451*a* or sends an output OUT_R2 signal to the selector 1451*b* based on select signals 1460 and 1461. The selector 1451*a* selects the OUT_R1 signal for driving a first color (e.g., red display element) of a group of display elements 1470 or selects the OUT_B1 signal for driving a second color (e.g., green display element) of the group of display elements 1470 of row 1411 based on select signals 1460 and 1461. A selector 1451*b* and output splitter 1452*b* are coupled to the logic 1456*b*. The output splitter 1452*b* receives output signals (e.g., OUT_G1, OUT_G2) from a current source of the driving logic 1456*b* and sends an output OUT_G1 signal to the selector 1451*a* or sends an output OUT_G2 signal to the selector 1451*c* based on select signals 1460 and 1461. The selector 1451*b* selects the OUT_B1 signal for driving third color (e.g., blue display element) of the group of display elements 1470 or selects the OUT_R2 signal for driving a first color (e.g., red display element) of the group of display elements 1471 based on select signals 1460 and 1461.

A selector 1451*c* and output splitter 1452*c* are coupled to the logic 1456*c*. The output splitter 1452*c* receives output signals (e.g., OUT_B1, OUT_B2) from a current source of the driving logic 1456*c* and sends an output OUT_B1 signal to the selector 1451*b* or sends an output OUT_B2 signal to the selector 1451*c* based on select signals 1460 and 1461. The selector 1451*c* selects the OUT_G2 signal for driving a second color (e.g., green display element) of the group of display elements 1471 or selects the OUT_B2 signal for driving a third color (e.g., blue display element) of the group of display elements 1471 based on select signals 1460 and 1461. The group of display elements may each form a pixel and each display element may form a subpixel.

In one example of the micro-drivers of FIGS. 13 and 14 that have been implemented in the display panel 1200 of FIG. 12, the redundant driver 1250 is not mounted and the micro-driver 1220 is programmed to emit display elements 1201, 1222, 1224, 1226, 1228, and 1230 and the micro-driver 1270 is programmed to emit display elements 1232, 1234, 1236, 1238, 1240, and 1242 during a first time period. The display elements 1121, 1223, 1225, 1227, 1229, 1231, 1233, 1235, 1237, 1239, 1241, and 1243 are disabled. During a second time period, the display elements 1201, 1222, 1224, 1226, 1228, 1230, 1232, 1234, 1236, 1238, 1240, and 1242 are disabled and the display elements 1121, 1223, 1225, 1227, 1229, 1231, 1233, 1235, 1237, 1239, 1241, and 1243 are emitted.

In another example, the redundant driver 1250 is mounted and the micro-driver 1220 is non-functional. Laser cutting is used to remove or cut the connections between the outputs 1250-1255 and the previously coupled display elements 1201, 1221-1231. The redundant micro-driver 1250 will replace the micro-driver 1220 in terms of driving the display elements 1226-1231. A micro-driver above the micro-driver 1220 will be used for driving the display elements 1201, 1221-1225. The micro-driver 1250 can be used for driving the display elements 1232-1237 or laser cutting can be used for removing or cutting the connections from the outputs 1291-*d-f* to the display elements 1232-1237. If these connections are removed, then the micro-driver 1270 will drive the display elements 1232-1237.

In this case for a first time period, the redundant micro-driver 1250 is programmed to emit display elements 1226, 1228, and 1230 during the first time period with the display elements 1227, 1229, and 1231 being disabled. The micro-driver 1270 can be programmed to emit display elements 1232, 1234, 1236, 1238, 1240, and 1242 during the first time period with the display elements 1233, 1235, 1237, 1239, and 1241, and 1243 being disabled.

During a second time period, the display elements 1226, 1228, and 1230 are disabled and the redundant micro-driver 1250 is programmed to emit the display elements 1227, 1229, and 1231. The display elements 1232, 1234, 1236, 1238, 1240, and 1242 are disabled during the first time period with the micro-driver 1270 being programmed to emit display elements 1233, 1235, 1237, 1239, and 1241, and 1243.

Figure 15:
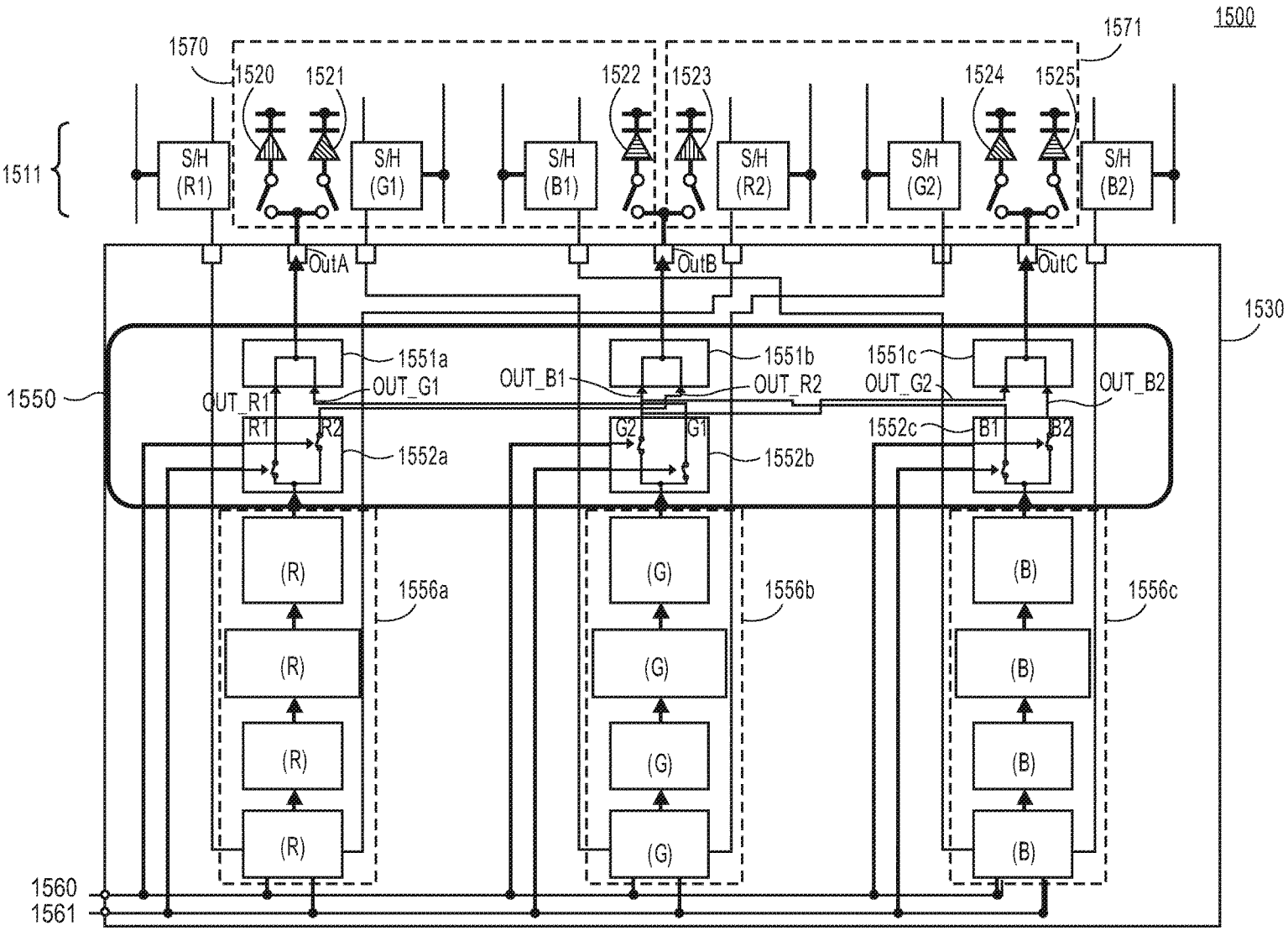
FIG. 15 illustrates a block diagram of a micro-driver of a display panel in accordance with another embodiment.

FIG. 15 illustrates a block diagram of a micro-driver of a display panel in accordance with another embodiment. A display panel 1500 includes similar components and functionality in comparison to the display panel 1400 of FIG. 14. In FIG. 15, the select unit 1550 is similar to the select unit 1450 except with modified selectors. The display panel 1500 includes display elements 1520-1525 arranged in a display element row 1511 of the display panel. A micro-driver 1530 is arranged in a row of micro-drivers adjacent and coupled to the display element row 1511. The micro-driver includes output nodes (outA-C) for driving emissions of the display element row 1511.

The micro-driver 1530 includes different logic 1556*a-c* (e.g., 1556*a-c* may include similar logic and components as logic 1356*a-c*) for driving different colors of the array of display elements or pixels. The select unit 1550 includes selectors 1551*a-c* and output splitters 1552*a-c* coupling the logic 1556*a-c* with an appropriate color of a display element.

In one embodiment, a selector 1551*a* and output splitter 1552*a* are coupled to the logic 1556*a* and the output splitter receives select signals 1560 and 1561. The output splitter 1552*a* receives output signals (e.g., OUT_R1, OUT_R2) from a current source of the driving logic 1556*b* and sends an output OUT_R1 signal to the selector 1551*a* or sends an output OUT_R2 signal to the selector 1551*b* based on select signals 1460 and 1461. The selector 1551*a* sends the OUT_R1 signal to a first color (e.g., red display element 1520) of a group of display elements 1570 or sends the OUT_G1 signal to a second color (e.g., green display element 1521) of the group of display elements 1570 of row 1511. The selector 1551*a* does not receive select signals 1560 and 1561 for this design. A selector 1551*b* and output splitter 1552*b* are coupled to the logic 1556*b*. The output splitter 1552*b* receives output signals (e.g., OUT_G1, OUT_G2) from a current source of the driving logic 1556*b* and sends an output OUT_G1 signal to the selector 1551*a* or sends an output OUT_G2 signal to the selector 1551*c* based on select signals 1560 and 1561. The selector 1551*b* sends an OUT_B1 signal to a third color (e.g., blue display element 1522) of the group of display elements 1570 or sends an OUT_R2 signal to a first color (e.g., red display element 1523) of the group of display elements 1571 without receiving the select signals 1560 and 1561.

A selector 1551*c* and output splitter 1552*c* are coupled to the logic 1556*c*. The output splitter 1552*c* receives output signals (e.g., OUT_B1, OUT_B2) from a current source of the driving logic 1556*c* and sends an output OUT_B1 signal to the selector 1551*b* or sends an output OUT_B2 signal to the selector 1551*c* based on select signals 1560 and 1561. The selector 1551*c* sends an OUT_G2 signal to a second color (e.g., green display element 1524) of the group of display elements 1571 or sends an OUT_B2 signal to a third color (e.g., blue display element 1525) of the group of display elements 1571 without receiving select signals 1560 and 1561. The group of display elements may each form a pixel and each display element may form a subpixel.

Figure 16:
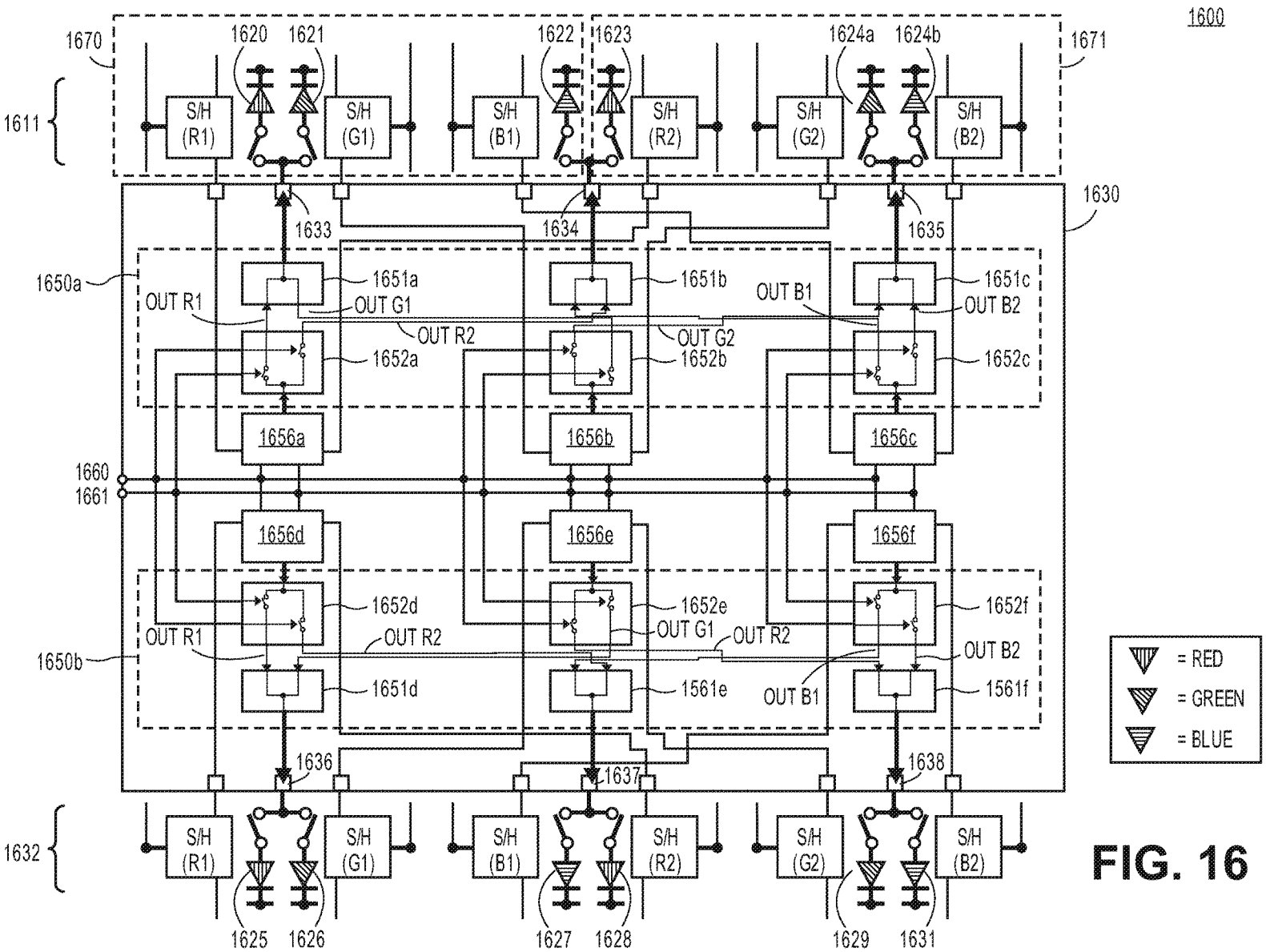
FIG. 16 illustrates a block diagram of a micro-driver of a display panel in accordance with another embodiment.

FIG. 16 illustrates a block diagram of a micro-driver of a display panel in accordance with another embodiment. A display panel 1600 includes similar components and functionality in comparison to the display panel 1500 of FIG. 15. The display panel 1600 includes display elements 1620-1624*a*, 1624*b* arranged in a display element row 1611 of the display panel and also display elements 1625-1629 and 1631 arranged in a display element row 1632. A micro-driver 1630 is arranged in a row of micro-drivers adjacent and coupled to the display element row 1611. The micro-driver includes output nodes 1633-1638 for driving emissions of the display element rows 1611 and 1632.

The micro-driver 1630 includes different logic 1656*a-f* for driving different colors of the array of display elements or pixels. The select unit 1650*a* includes selectors 1651*a-c* and output splitters 1652*a-c* coupling the logic 1656*a-c* with an appropriate color of a display element.

In one embodiment, a selector 1651*a* and output splitter 1652*a* are coupled to the logic 1656*a* and the output splitter receives select signals 1660 and 1661. The output splitter receives output signals (e.g., OUT_R1, OUT_R2) from a current source of the driving logic 1656*b* and sends an output OUT_R1 signal to the selector 1651*a* or sends an output OUT_R2 signal to the selector 1651*b* based on select signals 1660 and 1661. The selector 1651*a* sends the OUT_R1 signal to a first color (e.g., red display element 1620) of a group of display elements 1670 or sends the OUT_G1 signal to a second color (e.g., green display element 1621) of the group of display elements 1670 of row 1611. The selector 1651*a* does not receive select signals 1660 and 1661 for this design. A selector 1651*b* and output splitter 1652*b* are coupled to the logic 1656*b*. The output splitter 1652*b* receives output signals (e.g., OUT_G1, OUT_G2) from a current source of the driving logic 1656*b* and sends an output OUT_G1 signal to the selector 1651*a* or sends an output OUT_G2 signal to the selector 1651*c* based on select signals 1660 and 1661. The selector 1651*b* sends an OUT_B1 signal to a third color (e.g., blue display element 1622) of the group of display elements 1670 or sends an OUT_R2 signal to a first color (e.g., red display element 1623) of the group of display elements 1671 without receiving the select signals 1660 and 1661.

A selector 1651*c* and output splitter 1652*c* are coupled to the logic 1656*c*. The output splitter 1652*c* sends an output OUT_B1 signal to the selector 1651*b* or sends an output OUT_B2 signal to the selector 1651*c* based on select signals 1660 and 1661. The selector 1651*c* receives output signals (e.g., OUT_B1, OUT_B2) from a current source of the driving logic 1656*c* and sends an OUT_G2 signal to a second color (e.g., green display element 1624*a*) of the group of display elements 1671 or sends an OUT_B2 signal to a third color (e.g., blue display element 1624*b*) of the group of display elements 1671 without receiving select signals 1660 and 1661. The group of display elements may each form a pixel and each display element may form a subpixel. The select logic 1650*b* is configured in a similar manner as select logic 1650*a*.

In one example of the micro-drivers of FIGS. 15 and 16 that have been implemented in the display panel 1200 of FIG. 12, the redundant driver 1250 is not mounted and the micro-driver 1220 is programmed to emit display elements 1201, 1222, 1224, 1227, 1229, and 1231 and the micro-driver 1270 is programmed to emit display elements 1232, 1234, 1236, 1239, 1241, and 1243 during a first time period. The display elements 1121, 1223, 1225, 1226, 1228, 1230, 1233, 1235, 1237, 1238, 1240, and 1242 are disabled. During a second time period, the display elements 1201, 1222, 1224, 1227, 1229, 1231, 1232, 1234, 1236, 1239, 1241, and 1243 are disabled and the display elements 1121, 1223, 1225, 1226, 1228, 1230, 1233, 1235, 1237, 1238, 1240, and 1242 are emitted.

In another example, the redundant driver 1250 is mounted and the micro-driver 1220 is non-functional. Laser cutting is used to remove or cut the connections between the outputs 1250-1255 and the previously coupled display elements 1201, 1221-1231. The redundant micro-driver 1250 will replace the micro-driver 1220 in terms of driving the display elements 1226-1231. A micro-driver above the micro-driver 1220 will be used for driving the display elements 1201, 1221-1225. The micro-driver 1250 can be used for driving the display elements 1232-1237 or laser cutting can be used for removing or cutting the connections from the outputs 1291*d-f* to the display elements 1232-1237. If these connections are removed, then the micro-driver 1270 will drive the display elements 1232-1237.

In this case for a first time period, the redundant micro-driver 1250 is programmed to emit display elements 1226, 1228, and 1230 during the first time period with the display elements 1227, 1229, and 1231 being disabled. The micro-driver 1270 can be programmed to emit display elements 1232, 1234, 1236, 1239, 1241, and 1243 during the first time period with the display elements 1233, 1235, 1237, 1238, and 1240, and 1242 being disabled.

During a second time period, the display elements 1226, 1228, and 1230 are disabled and the redundant micro-driver 1250 is programmed to emit the display elements 1227, 1229, and 1231. The display elements 1232, 1234, 1236, 1239, 1241, and 1243 are disabled during the second time period with the micro-driver 1270 being programmed to emit display elements 1233, 1235, 1237, 1238, and 1240, and 1242.

In this manner, redundant micro-drivers can replace non-functional micro-drivers.

Figure 17:
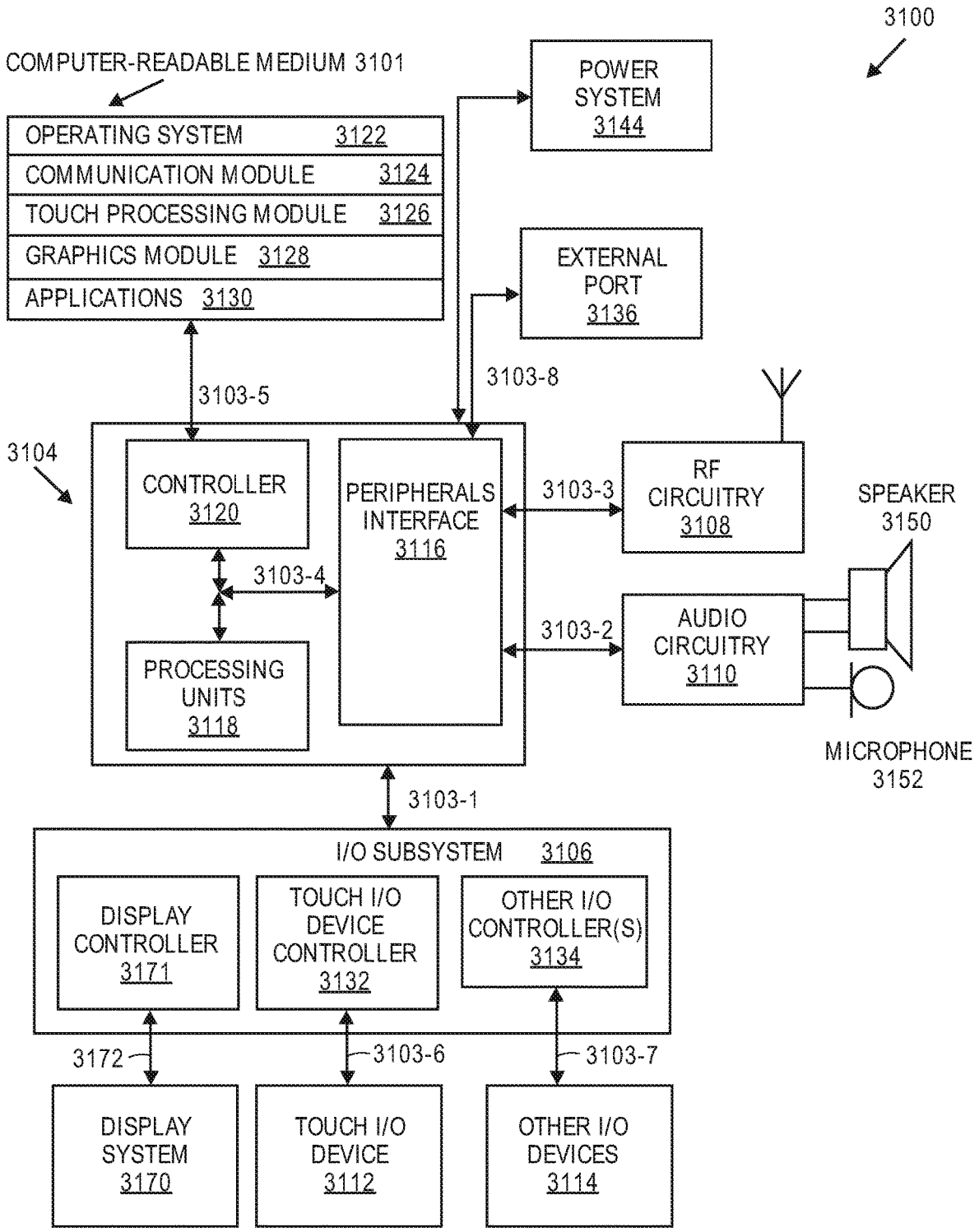
FIG. 17 is a block diagram of one embodiment of the present disclosure of system 3100 that generally includes one or more computer-readable mediums 3101, processing system 3104, Input/Output (I/O) subsystem 3106, radio frequency (RF) circuitry 3108 and audio circuitry 3110.
Figure 18:
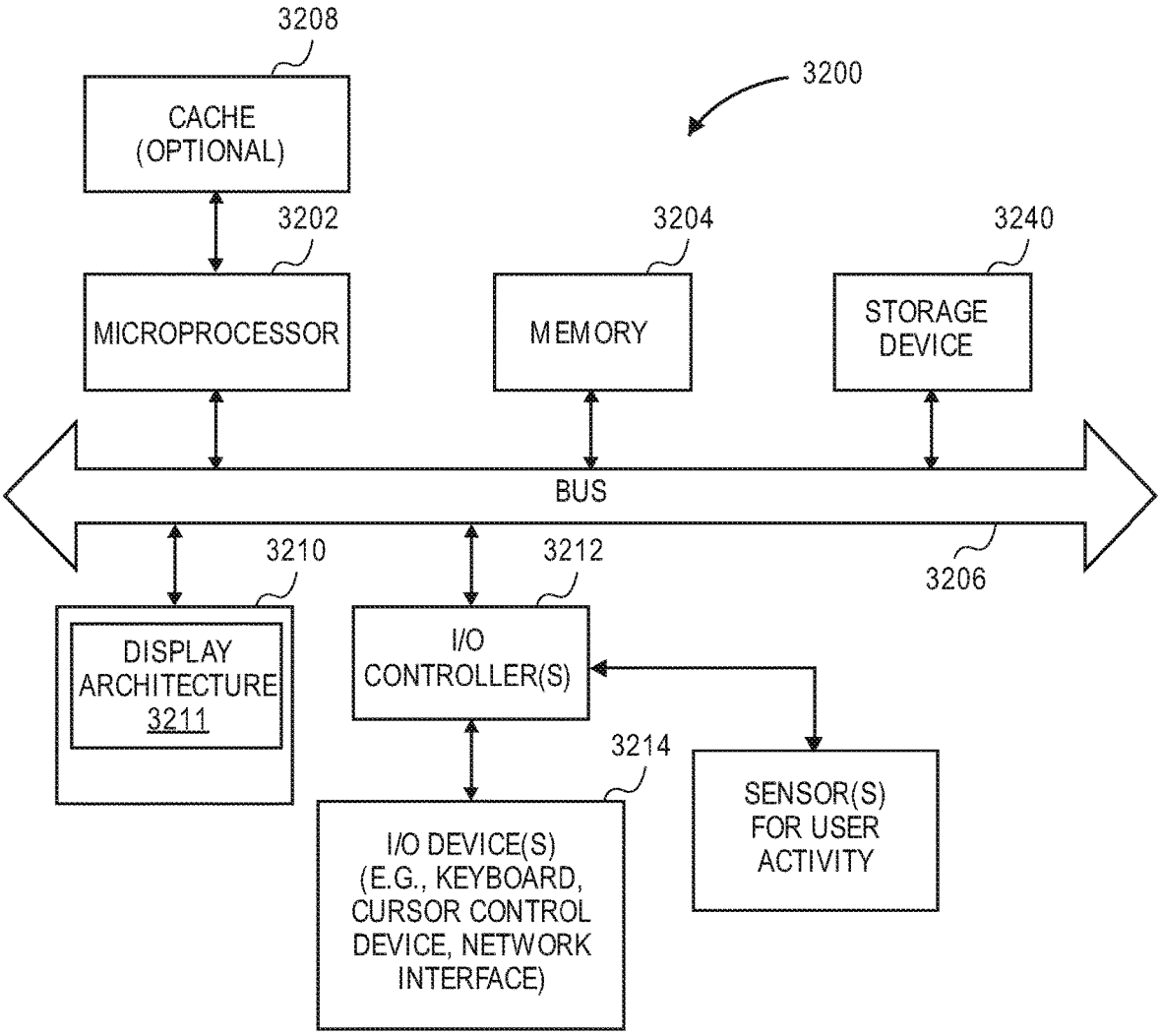
FIG. 18 shows another example of a device according to an embodiment of the disclosure.

In some embodiments, the methods, systems, and apparatuses of the present disclosure can be implemented in various devices including electronic devices, consumer devices, data processing devices, desktop computers, portable computers, wireless devices, cellular devices, tablet devices, display screens, televisions, handheld devices, multi touch devices, multi touch data processing devices, wearable devices, any combination of these devices, or other like devices. FIGS. 17 and 18 illustrate examples of a few of these devices.

Attention is now directed towards embodiments of a system architecture that may be embodied within any portable or non-portable device including but not limited to a communication device (e.g., mobile phone, smart phone, smart watch, wearable device), a multi-media device (e.g., MP3 player, TV, radio), a portable or handheld computer (e.g., tablet, netbook, laptop), a desktop computer, an All-In-One desktop, a peripheral device, a television, or any other system or device adaptable to the inclusion of system architecture 3100, including combinations of two or more of these types of devices.

FIG. 17 is a block diagram of one embodiment of the system 3100 that generally includes one or more computer-readable mediums 3101, processing system 3104, Input/Output (I/O) subsystem 3106, radio frequency (RF) circuitry 3108 and audio circuitry 3110. These components may be coupled by one or more communication buses or signal lines 3103 (e.g., 3103-1, 3103-2, 3103-3, 3103-4, 3103-5, 3103-6, 3103-7, 3108-8).

It should be apparent that the architecture shown in FIG. 17 is only one example architecture of system 3100, and that system 3100 could have more or fewer components than shown, or a different configuration of components. The various components shown in FIG. 17 can be implemented in hardware, software, firmware or any combination thereof, including one or more signal processing and/or application specific integrated circuits.

RF circuitry 3108 is used to send and receive information over a wireless link or network to one or more other devices and includes well-known circuitry for performing this function. RF circuitry 3108 and audio circuitry 3110 are coupled to processing system 3104 via peripherals interface 3116. Interface 3116 includes various known components for establishing and maintaining communication between peripherals and processing system 3104. Audio circuitry 3110 is coupled to audio speaker 3150 and microphone 3152 and includes known circuitry for processing voice signals received from interface 3116 to enable a user to communicate in real-time with other users. In some embodiments, audio circuitry 3110 includes a headphone jack (not shown).

Peripherals interface 3116 couples the input and output peripherals of the system to processing units 3118 and computer-readable medium 3101. One or more processing units 3118 communicate with one or more computer-readable mediums 3101 via controller 3120. Computer-readable medium 3101 can be any device or medium (e.g., storage device, storage medium) that can store code and/or data for use by one or more processing units 3118. Medium 3101 can include a memory hierarchy, including but not limited to cache, main memory and secondary memory. The memory hierarchy can be implemented using any combination of RAM (e.g., SRAM, DRAM, DDRAM), ROM, FLASH, magnetic and/or optical storage devices, such as disk drives, magnetic tape, CDs (compact disks) and DVDs (digital video discs). Medium 3101 may also include a transmission medium for carrying information-bearing signals indicative of computer instructions or data (with or without a carrier wave upon which the signals are modulated). For example, the transmission medium may include a communications network, including but not limited to the Internet (also referred to as the World Wide Web), intranet(s), Local Area Networks (LANs), Wide Local Area Networks (WLANs), Storage Area Networks (SANs), Metropolitan Area Networks (MAN) and the like.

One or more processing units 3118 run various software components stored in medium 3101 to perform various functions for system 3100. In some embodiments, the software components include operating system 3122, communication module (or set of instructions) 3124, touch processing module (or set of instructions) 3126, graphics module (or set of instructions) 3128, and one or more applications (or set of instructions) 3130. In some embodiments, medium 3101 may store a subset of the modules and data structures identified above. Furthermore, medium 3101 may store additional modules and data structures not described above.

Operating system 3122 includes various procedures, sets of instructions, software components and/or drivers for controlling and managing general system tasks (e.g., memory management, storage device control, power management, etc.) and facilitates communication between various hardware and software components.

Communication module 3124 facilitates communication with other devices over one or more external ports 3136 or via RF circuitry 3108 and includes various software components for handling data received from RF circuitry 3108 and/or external port 3136.

Graphics module 3128 includes various known software components for rendering, animating and displaying graphical objects on a display surface. In embodiments in which touch I/O device 3112 is a touch sensitive display (e.g., touch screen), graphics module 3128 includes components for rendering, displaying, and animating objects on the touch sensitive display. The display architecture (e.g., display architecture 100, 200, 300, 400, 500, 600, 800, 900, 1000) of the present design, which may be implemented with display controller 3171 and display system 3170, may be implemented in at least one of the touch I/O device and the touch I/O device controller or may be located as separate components as illustrated in FIG. 20. The display controller and display system are coupled via communication link 3172.

One or more applications 3130 can include any applications installed on system 3100, including without limitation, a game center application, a browser, address book, contact list, email, instant messaging, word processing, keyboard emulation, widgets, JAVA-enabled applications, encryption, digital rights management, voice recognition, voice replication, location determination capability (such as that provided by the global positioning system (GPS)), a music player, etc.

Touch processing module 3126 includes various software components for performing various tasks associated with touch I/O device 3112 including but not limited to receiving and processing touch input received from 110 device 3112 via touch I/O device controller 3132.

FIG. 18 shows another example of a device according to an embodiment of the disclosure. This device 3200 may include one or more processors, such as microprocessor(s) 3202, and a memory 3204, which are coupled to each other through a bus 3206. The device 3200 may optionally include a cache 3208 which is coupled to the microprocessor(s) 3202. The device may optionally include a storage device 3240 which may be, for example, any type of solid-state or magnetic memory device. Storage device 3240 may be or include a machine-readable medium.

This device may also include a display controller and display device 3210 which is coupled to the other components through the bus 3206. The display architecture 3211 (e.g., display architecture 100, 200, 300, 400, 500, 600, 800, 900, 1000) of the present design may be implemented in the display controller and display device 3210.

One or more input/output controllers 3212 are also coupled to the bus 3206 to provide an interface for input/output devices 3214 and to provide an interface for one or more sensors 3216 which are for sensing user activity. The bus 3206 may include one or more buses connected to each other through various bridges, controllers, and/or adapters as is well known in the art. The input/output devices 3214 may include a keypad or keyboard or a cursor control device such as a touch input panel. Furthermore, the input/output devices 3214 may include a network interface which is either for a wired network or a wireless network (e.g. an RF transceiver). The sensors 3216 may be any one of the sensors described herein including, for example, a proximity sensor or an ambient light sensor. In at least certain implementations of the device 3200, the microprocessor(s) 3202 may receive data from one or more sensors 3216 and may perform the analysis of that data in the manner described herein.

In certain embodiments of the present disclosure, the device 3200 or device 3100 or combinations of devices 3100 and 3200 can be used to drive display data to a display device and implement at least some of the methods discussed in the present disclosure.

In utilizing the various embodiments of this disclosure, it would become apparent to one skilled in the art that combinations or variations of the above embodiments are possible for controlling emission of a display panel. Although the present disclosure has been described in language specific to structural features and/or methodological acts, it is to be understood that the disclosure defined in the appended claims is not necessarily limited to the specific features or acts described. The specific features and acts disclosed are instead to be understood as particularly graceful implementations of the claimed disclosure useful for illustrating the present disclosure.

What is claimed is:

1. A display comprising:

a backplane including a circuitry for sampling and holding analog data and for time multiplexing the analog data in a current domain; and a micro-driver circuitry coupled to the backplane, wherein the micro-driver circuitry includes at least a capacitor of a ramp generator that is charged for generating a ramp voltage based on the analog data of the backplane and the micro-driver circuitry includes drive circuitry to cause at least one emission pulse for emitting a display element.

2. The display of claim 1, wherein the circuitry comprises at least one transistor for each row of data to be time multiplexed in a current domain from the backplane to the micro-driver circuitry, wherein the micro-driver circuitry is a surface-mounted micro-driver chip, wherein the micro-driver chip has a maximum lateral dimension of 1 to 300 microns.

3. The display of claim 2, wherein the circuitry further comprises a data scan switch and a capacitor for data storage for each row of data to be time multiplexed.

4. The display of claim 2, further comprising:

a display circuitry having a plurality of display elements, wherein the display circuitry is configured to receive the at least one emission pulse from the drive circuitry with the at least one emission pulse being applied to one or more rows of display elements.

5. The display of claim 4, wherein the display circuitry shares a single pin with a selected column or color of display elements being selected based on time multiplexing.

6. The display of claim 4, wherein the drive circuitry comprises a plurality of transistors for driving the emission pulses with a first transistor coupled to a first color of display elements, a second transistor coupled to a second color of display elements, and a third transistor coupled to a third color of display elements.

7. The display of claim 6, wherein the micro-driver circuitry further comprises a plurality of switches with each switch being capable of selecting a row of display elements to be enabled for receiving the at least one emission pulse.

8. The display of claim 6, wherein the backplane further comprises a plurality of switches with each being capable of selecting a row of display elements to be enabled for receiving the at least one emission pulse.

9. The display of claim 6, wherein the backplane further comprises a plurality of switches coupled to the display elements with a first group of the plurality of switches being capable of selecting a first row of display elements to be enabled for receiving the at least one emission pulse and a second group of the plurality of switches being capable of selecting a second row of display elements to be enabled for receiving the at least one emission pulse.

10. The display of claim 1, wherein the backplane includes transistors to be implemented by at least one of Low Temperature Poly Silicon transistor or oxide transistor, wherein the micro-driver circuitry comprises a single crystalline silicon substrate.

11. The display of claim 1, wherein each emission pulse has a pulse width that is a function of an analog input current provided by the backplane.

12. The display architecture of claim 1, wherein the ramp generator includes two control signals for selecting analog input data signals and for resetting the capacitor of the ramp generator.

13. A display comprising:

a backplane including a circuitry for sampling and holding analog data, and for time multiplexing the analog data, and a capacitor to charge for generating a ramp voltage; and a micro-driver circuitry coupled to the backplane, the micro-driver circuitry configured to cause at least one emission pulse, each emission pulse having a pulse width that is based on a slope of the ramp voltage.

14. The display of claim 13, wherein the circuitry comprises at least one transistor for each row of data to be time multiplexed from the backplane to the micro-driver circuitry.

15. The display of claim 13, further comprising:

a light emitting diode (LED) circuitry having a plurality of light emitting diodes (LEDs), wherein the LED circuitry is configured to receive the at least one emission pulse from the micro-driver circuitry with the at least one emission pulse being applied to one or more rows of LEDs.

16. The display architecture of claim 15, wherein the LED circuitry shares a single pin with a selected column or color of LEDs being selected based on time multiplexing.

17. A micro-driver circuitry comprising:

a ramp generator having a capacitor for generating a ramp voltage based on analog input data to be time multiplexed in a current domain of a backplane; and drive circuitry coupled to the ramp generator, the drive circuitry configured to drive current to cause at least one emission pulse, each emission pulse having a pulse width that is based on a slope of the ramp voltage.

18. The micro-driver circuitry of claim 17, further comprising:

select logic coupled to the capacitor, the select logic comprises at least one transistor for each row of analog input data.

19. The micro-driver circuitry of claim 18, wherein the drive circuitry is configured to drive current to cause at least one emission pulse to be applied to a light emitting diode (LED) circuitry having a plurality of light emitting diodes (LEDs), wherein the LED circuitry is configured to receive the at least one emission pulse from the drive circuitry with the at least one emission pulse being applied to one or more rows of LEDs.

20. The micro-driver circuitry of claim 19, wherein the drive circuitry is configured to cause at least one emission pulse to be applied to a single pin with a selected column or color of LEDs being selected based on time multiplexing utilizing the single pin.

21. A display panel comprising:

a first plurality of display elements arranged in a first display row of the display panel; and a first micro-driver arranged in a first row of micro-drivers adjacent and coupled to the first display row, wherein the first micro-driver includes:

a first driving logic for driving a first color of the first plurality of display elements without driving a second color and a third color of the first plurality of display elements, a first select unit coupled to the first driving logic, the first select unit configured to select an output signal for driving the first color of a first display element or to select an output signal for driving the second color of a second display element of the first plurality of display elements;

a second driving logic for driving the second color of the first plurality of display elements, and a second select unit coupled to the second driving logic, the second select unit configured to select an output signal for driving the third color of a third display element or to select an output signal for driving the first color of a fourth display element of the first plurality of display elements.

22. The display panel of claim 21, further comprising:

a third driving logic for driving the third color of the first plurality of display elements and a third select unit coupled to the third driving logic, the third select unit configured to select an output signal for driving the second color of a fifth display element or the third color of a sixth display element of the first plurality of display elements.

23. The display panel of claim 21, further comprising:

a second micro-driver arranged in a second row of micro-drivers; and a second plurality of display elements arranged in a second display row adjacent to the first and second rows of micro-drivers.

24. The display panel of claim 23, wherein a pitch of the first and second rows of micro-drivers is approximately equal to a pitch of rows of the backplane.

25. The display panel of claim 23, wherein the first micro-driver is a first surface mounted micro-driver chip, and the second micro-driver is a second surface mounted micro-driver chip.

* * * * *